US009783267B1

(12) United States Patent
Alexander et al.

(10) Patent No.: US 9,783,267 B1
(45) Date of Patent: Oct. 10, 2017

(54) COVER SYSTEM

(71) Applicant: Dowco, Inc., Manitowoc, WI (US)

(72) Inventors: Jon Alexander, West Bend, WI (US); Bradley Prey, Green Bay, WI (US); Mark T. Sterwald, Manitowoc, WI (US); John Shackleton, New Holstein, WI (US)

(73) Assignee: Dowco, Inc., Manitowoc, WI (US)

( * ) Notice: Subject to any disclaimer, the term of this patent is extended or adjusted under 35 U.S.C. 154(b) by 0 days.

(21) Appl. No.: 15/434,518

(22) Filed: Feb. 16, 2017

(51) Int. Cl.
*B63B 17/02* (2006.01)
*B60J 11/04* (2006.01)
*B63B 19/00* (2006.01)
*B63B 17/04* (2006.01)

(52) U.S. Cl.
CPC ..... *B63B 17/02* (2013.01); *B63B 17/04* (2013.01); *B63B 19/00* (2013.01); *B63B 2017/026* (2013.01); *B63B 2019/0053* (2013.01); *B63B 2710/00* (2013.01)

(58) Field of Classification Search
CPC ... B63B 17/02; B63B 19/00; B63B 2017/026; B63B 2019/0053; B60J 11/04
USPC ..... 52/3; 135/88.01; 114/361; 296/136.01, 296/136.1, 136.11, 136.12; 150/166
See application file for complete search history.

(56) References Cited

U.S. PATENT DOCUMENTS 2,570,533 A * 10/1951 Elliott ..... B60J 11/00 150/166
2,571,362 A * 10/1951 Hervey ..... B60J 11/00 135/119
2,646,097 A * 7/1953 Gaverth ..... B60J 11/02 135/115
2,821,989 A * 2/1958 Shepard ..... B63B 17/02 114/361
3,354,892 A * 11/1967 Frieder ..... B63B 17/02 114/361
3,399,687 A * 9/1968 Frieder ..... B63B 17/02 114/361
3,489,452 A 1/1970 Plante
3,698,409 A * 10/1972 Koontz ..... B63B 17/02 114/361
4,075,723 A * 2/1978 Bareis ..... B63B 17/02 114/361
5,303,667 A * 4/1994 Zirkelbach ..... B63B 17/02 114/361
5,522,409 A * 6/1996 May ..... B60J 11/00 135/126
5,697,320 A * 12/1997 Murray ..... B63B 17/02 114/361
5,706,752 A 1/1998 Menne, Jr.
(Continued)

OTHER PUBLICATIONS

Youtube Screen capture (https://www.youtube.com/watch?v=k9vbnj5KYq0) admitted prior art for the purposes of prosecution.

(Continued)

*Primary Examiner* — Robert Canfield
(74) *Attorney, Agent, or Firm* — Shane Delsman; Godfrey & Kahn, S.C.

(57) ABSTRACT

A cover system for a vehicle, such as a boat, including a ratchet and a strap that is in part supported by a frame, such as a canopy frame. The strap cooperates with at least part of the frame to provide support and form to the cover such that water will run off the cover.

24 Claims, 25 Drawing Sheets

(56) References Cited

U.S. PATENT DOCUMENTS 5,743,208 A * 4/1998 Miller ..... B63B 17/02 114/361
5,803,104 A 9/1998 Pollen
5,941,594 A * 8/1999 O'Neill ..... B60J 11/00 150/166
6,006,692 A * 12/1999 Szukhent, Jr. ..... B63B 17/02 114/361
6,129,034 A 10/2000 Santa Cruz et al.
6,209,477 B1 4/2001 Biedenweg
6,637,364 B1 * 10/2003 Campeau ..... B63B 17/02 114/361
6,666,163 B2 12/2003 Pastor
6,672,241 B2 1/2004 Warfel
6,789,495 B2 9/2004 Brower
6,983,716 B1 1/2006 Ankney
7,063,035 B2 6/2006 Belcher
7,107,926 B2 * 9/2006 Fishburn ..... B63B 17/02 114/361
7,204,466 B2 4/2007 Hsieh
7,418,919 B2 9/2008 Smith et al.
7,536,971 B1 5/2009 Fry
7,571,691 B2 8/2009 Russikoff
7,895,964 B2 3/2011 Russikoff
7,921,797 B2 4/2011 James
7,950,342 B2 5/2011 Russikoff
8,418,708 B2 * 4/2013 Benish ..... E04H 15/06 135/88.07
8,616,511 B2 12/2013 James
8,752,498 B1 6/2014 Schwindaman
8,875,646 B2 11/2014 Zirkelbach et al.
8,950,416 B1 * 2/2015 Spellman ..... B63B 17/02 114/361
2008/0066794 A1 3/2008 Durfee
2010/0083891 A1 * 4/2010 Russikoff ..... B63B 17/02 114/361
2011/0290170 A1 12/2011 Russikoff
2014/0026803 A1 * 1/2014 Musacchio ..... B63B 17/02 114/361
2015/0047550 A1 2/2015 Zirkelbach et al.
2015/0210150 A1 7/2015 Alexander
2016/0129974 A1 5/2016 Hough
2017/0057600 A1 3/2017 Hough

OTHER PUBLICATIONS

Website screenshot; https://web.archive.org/web/20131108112133/http://www.canvas-boat-cover-and-repair-advisor.com/boat-cover-supports.html; Nov. 8, 2013.
Website screenshot; https://web.archive.org/web/20131020233755/http://www.wayfair.com/Navigloo-19-to-22%C2%BD-ft-Storage-System-Fishing-Runabout-with-Tarpaulin-Cover-3370-NAVI1004.html; Oct. 20, 2013.
Website screenshot; https://ww.youtube.com/watch?v=-1jGOfijilVM; published Dec. 12, 2003.
Website screenshot; https://web.archive.org/web/20120820000834/http://www.websweeper.com/php/boat_covers/bc-018.php; Aug. 20, 2012.
Website screenshot; https://web.archive.org/web/20130925032949/http://www.outdoorfabricscanada.com/Vents-Mooring-Supports_c_304.html; Sep. 25, 2013.

* cited by examiner

COVER SYSTEM

FIELD OF THE INVENTION

The present invention relates generally to the field of vehicles such as boats. More particularly, the present invention relates to cover systems for such vehicles.

BACKGROUND

Vehicles require upkeep and maintenance. One example of such maintenance is the frequent activity of uncovering and covering a boat or automobile, such as before and after use. Generally, covers must be sized such that they are larger than the structure they are designed to cover. This allows the cover to be more easily put on a vehicle. After the cover is added to a boat or other vehicle, support must be given to the cover so that it does not have slack or otherwise have slumps where water could build up and pool. The cover must also be given shape so that the water runs towards and off the sides of the vehicle.

Current methods of adding tension, support and/or shape to a cover, for example on a boat, rely on tent poles that must be installed under the cover. This is usually done after the cover is partially attached. Subsequent movement of the cover, such as by wind or trailer movement, can cause the poles to become dislodged. Once a single pole has been dislodged or lost, the cover will not perform its job. As a result, water can collect on the cover and lead to stretching, deformed appearance, damage, leaks or reduction of the useful life of the cover, and also water entering the area for which protection is desired.

In order to install support poles, someone must go inside the boat or vehicle and under the cover. Therefore, the person installing the support poles must crawl around, in the dark, trying to set up the poles without disturbing the poles that are already set up. Further, the poles must be stored somewhere when the boat is in use, potentially on the boat, causing less room on the boat and potentially a tripping hazard.

The boating industry includes many recreational users. Recreational users may choose to leave such covers off entirely so as to avoid the frustration, discomfort and time required to set up support poles under the cover. This results in accelerated wear and damage to the boat.

Many covers are used for a specific type of boat, model and even different sizes and configurations of a single model. For example, the interior space of pontoon boat can be changed based upon the desires of the owner and/or the intended use. In some configurations, the pontoon boat may have seating that rises above the fence or rail of the pontoon boat. In other configurations there may be no such seating. A cover that would fit the pontoon boat without seating typically would not be able to sufficiently fit a pontoon boat with such seating. Further, if the cover for a boat with seating was used with a pontoon boat without seating, it would be larger than necessary and the cover would form depressions or pockets where water would sit and pool.

The current use of making and selling a large number of covers requires manufacturers to make a large number of different covers, a retailer to stock a large number of covers and a boat owner to get a new cover if he or she gets a new boat or even if he or she changes the configuration of boat. These inefficiencies add expense to the cost of covers such as by an increase in the number of manufacturing lines and in shelf space dedicated to covers or warehouse space.

As such, there is a need for a cover that does not require a support pole or other such unstable structure to provide support and is easy to install on a vehicle. There is also a need to be able to use a single cover for a number of different sizes and configurations of a model, different models or even different types of vehicles.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Support and form is provided to a cover 10 by an existing structure of a vehicle 12. Such a cover or enclosure system can be used on different configurations of a vehicle 12, models of a vehicle and/or vehicle styles.

For example, in the marine industry, some current covers use tent poles that must be placed in a boat, for example, to create tension on the cover and a high point from which to shed water. United States Patent Publication Number 2015/0210150 by one of the inventors of the present application, which is hereby incorporated by reference herein in its entirety for all purposes, discloses a cover that uses the windshield of a boat to create a high point and create tension on the cover to shed water. However, not all boats have a windshield, for example, pontoon boats and bass boats. Other boats have a wind screen, for example skiffs. However, wind screens may not be able to withstand the compressive forces a cover would put on it. In one embodiment seen in FIGS. 1-17, the vehicle is a pontoon boat 12 and the cover 10 uses the frame or structure 14 for a marine top, canopy, bimini or other such structure. Although a pontoon boat is shown for exemplar and illustrative purposes, the vehicle could be another type of boat, e.g. a skiff, or another type of vehicle, e.g. an automobile.

Figure 2:
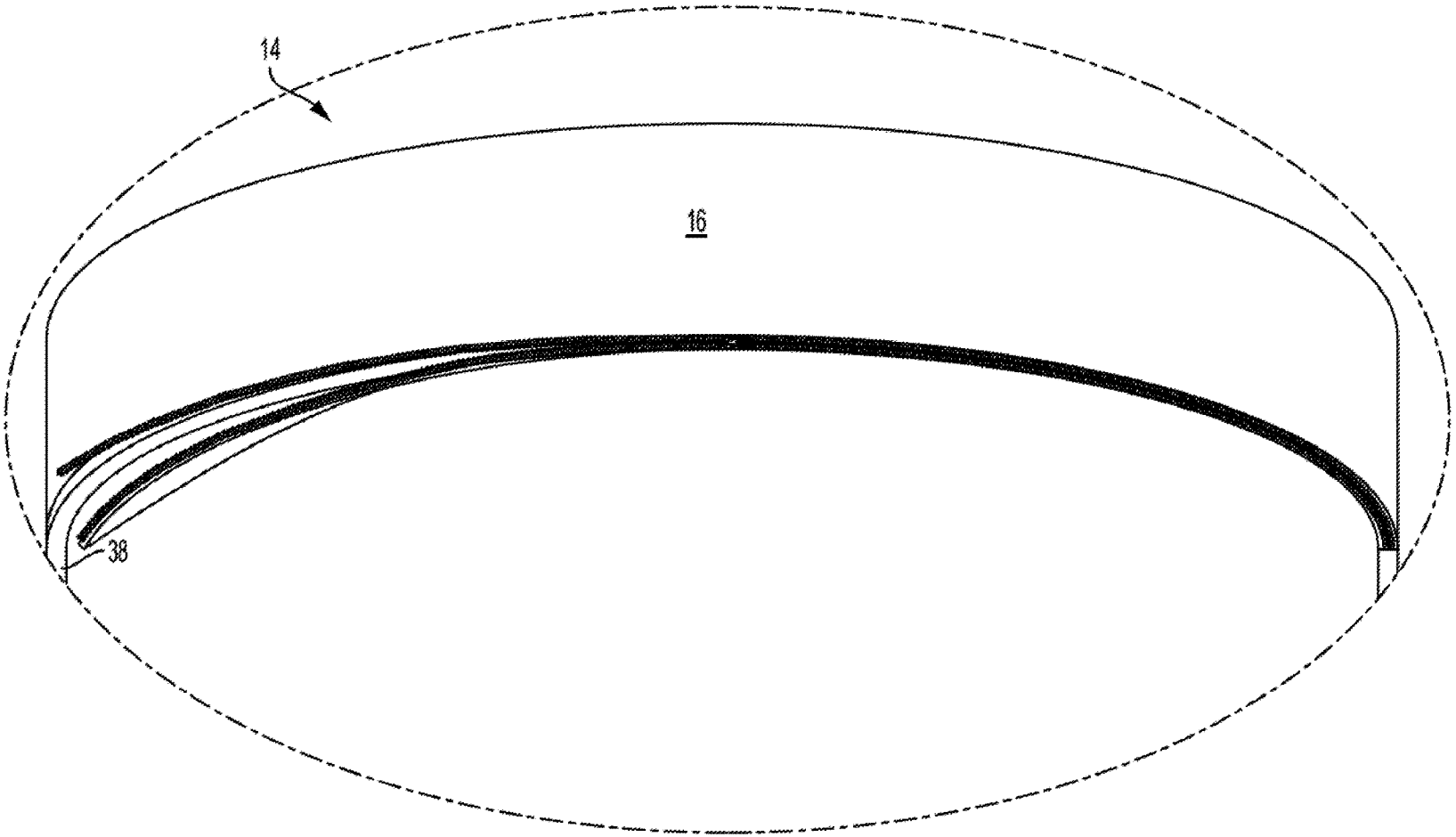
FIG. 2 is an enlarged view of a portion of the bimini in FIG. 1 taken along line 2.
Figure 3:
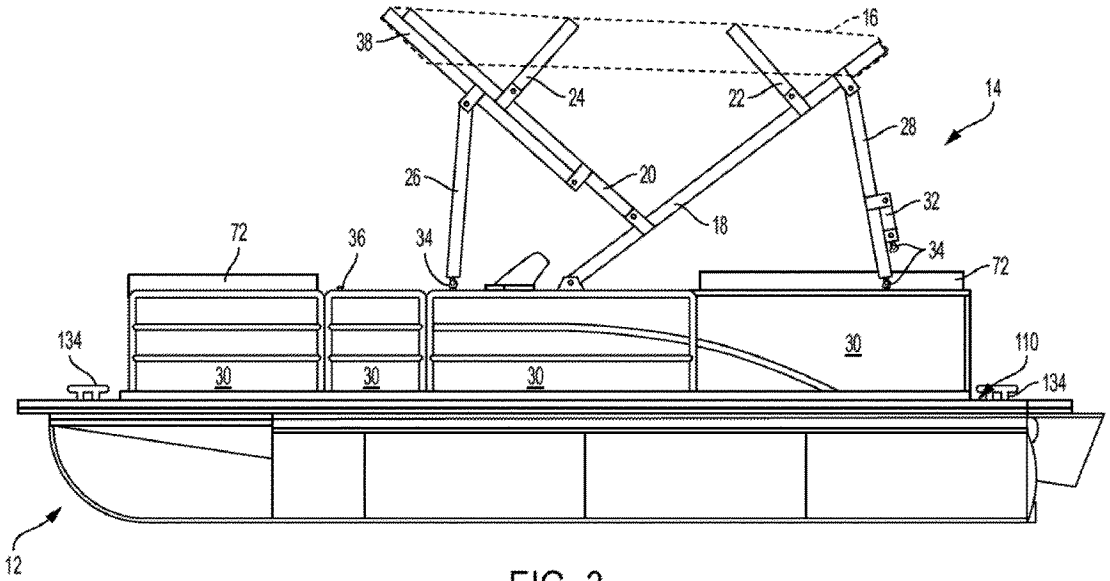
FIG. 3 is an elevation side view of the boat in FIG. 1.
Figure 4:
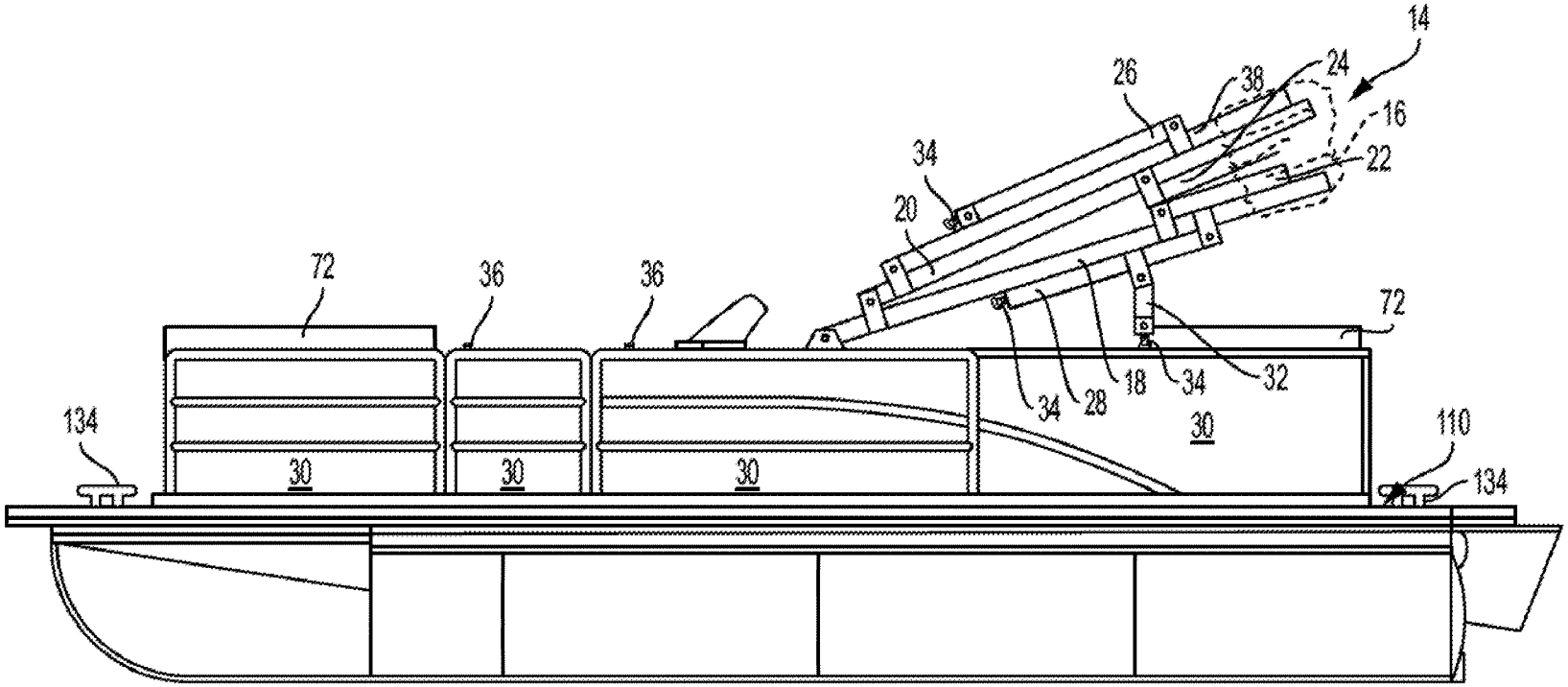
FIG. 4 is an elevation side view of the boat in FIG. 3 with the bimini in a trailered position.

The movable marine frame 14 shown in FIGS. 1-5 is generally comprised of a number of structural members that support a canopy 16 for providing shade or shelter from the elements. For example, the frame 14 in FIG. 1 includes a main or aft bow 18 that is pivotally connected to a secondary or bow bow 20. One or more auxiliary bows 22, 24 can be pivotally connected to the main and secondary bows. The pivotal connections allow the frame 14 to collapse into a compact folded frame or trailering or first position as seen in FIG. 4.

Figure 1:
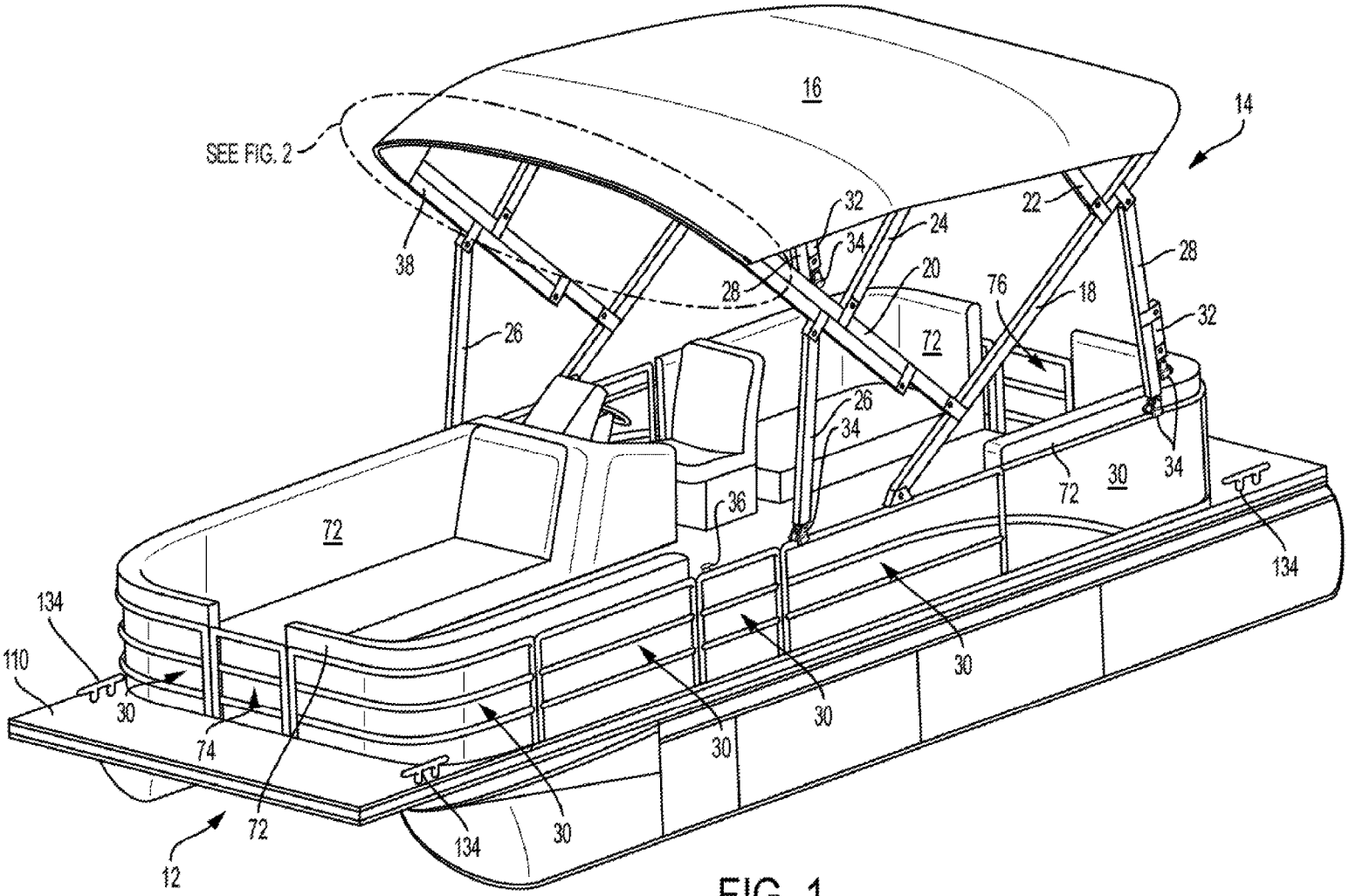
FIG. 1 is a perspective view of a boat with a bimini in a fully deployed position.

Front support members or struts 26 and rear support members or struts 28, for example one on the starboard side and one on the port side of the frame 14, may also be used to support and keep or secure the frame to the boat 12 in the radar or second position, e.g. FIGS. 1-3, and/or collapsed position, e.g. FIG. 4. For example, the corollary bow 38 has a front strut 26 to selectively hold the frame 14 in the radar position and, alternatively, the corollary bow in the cover position and secure it to the boat 12. Alternatively, the frame 14 could be secured by other means, such as straps or as disclosed in U.S. patent application Ser. Nos. 14/934,291; 15/347,479 and 15/373,191, owned by the owner of the present application, which are hereby incorporated by reference herein in their entirety for all purposes.

When the frame 14 is collapsed and in its trailering position, the frame can be secured to the boat 12, for example to the fence 30, by a shortened support member 32 as seen in FIG. 4. The front, rear and shortened support members 26, 28, 32 can be selectively connected to the boat 12, for example to the fence 30, by a number of known means in the industry, for example a bracket, ratchet member, clip 34 and Dowcolok quick connect button 36, etc.

Figure 5:
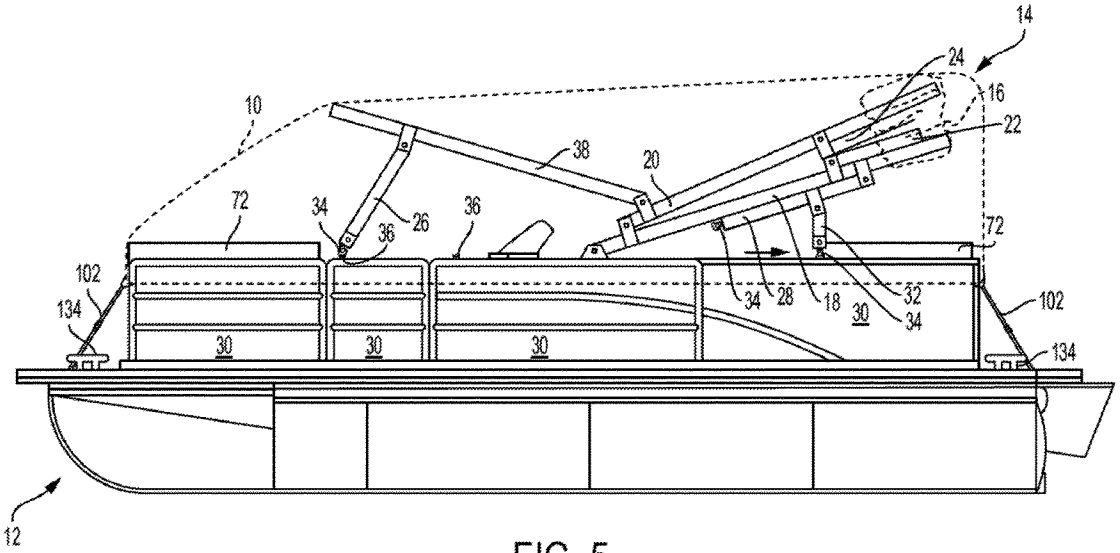
FIG. 5 is an elevation side view of the boat in FIG. 3 with the bimini in a trailered position and a bow in a position to support a cover.

One of the number of structural members of the frame 14 for a canopy 16 shown in FIGS. 1-5 is corollary bow 38. The canopy 16 has a compartment at the front through which bow bow 20 and corollary bow 38 are held and which allows the corollary bow capable of being connected or engaged to and disengaged from the frame as seen in FIG. 5. The compartment of the canopy 16 can be opened, for example by unzipping, and the corollary bow 38 can be removed from the canopy as seen in FIG. 2 to selectively disconnect or disengage the corollary bow from the frame. If the frame 14 is in the deployed position as seen in FIGS. 1-3, the remaining portion of the frame can be rotated back to its unemployed or stowed position as seen in FIG. 5. If the frame 14 is in the stowed position, as seen in FIG. 4, the corollary bow 38 can be rotated forward to a supporting position, independent of the frame 14, as seen in FIG. 5. The cover or support position, as shown in the embodiment seen in FIG. 5, is forward of the canopy position, which is the position the corollary bow 38 is in when the frame 14 is normally deployed.

Figure 5A:
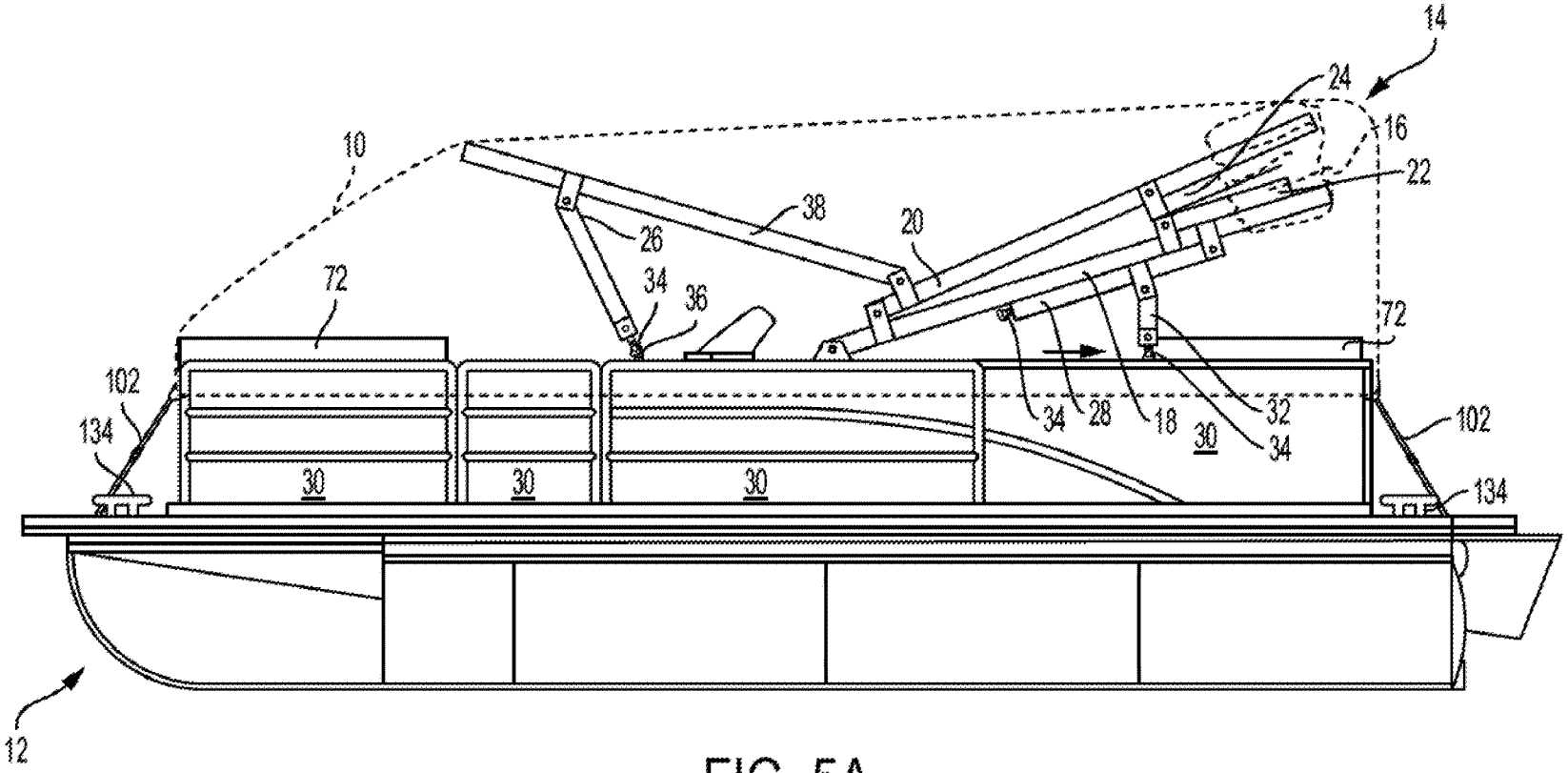
FIG. 5A is an elevation side view an alternative embodiment of the boat with the bimini in a trailered position and a bow in a position to support a cover.

In one embodiment, the corollary bow 38 is attached to the boat 12 by the front strut 26 at a first location when in the fully employed position, FIG. 1, and at a second location when the corollary bow is in the support position, FIG. 5. In another embodiment, the corollary bow 38 attached to the bow bow 20 such that when the frame 14 is rotated back towards the stowed position, the corollary bow is also pulled backwards, as seen in FIG. 5A. With the corollary bow 38 moved further towards the stern of the boat 12, the front strut 26 may connect to the boat 12 at the same location as it does in when the frame 14 is in the fully employed position, but secure the corollary bow in the support position.

With the corollary bow 38 in the cover position, the cover 10 may be installed on the boat 12. One way to install the cover 10 is to roll the cover over the boat 12 and corollary bow 38 starting at the rear and working towards the front of the boat. Once on the boat 12, the cover 10 can then be secured or attached and fit to the boat to cover the opening and/or protect the interior, e.g. from rain, as will be described further below.

The cover 10 generally includes a securing means for attaching the cover to the boat 12 and a tensioning means 40 such that after the cover is attached to the boat, the cover can be tightened and/or tensioned, thereby giving the cover support and form. The tensioning means 40 could be located under the cover material or sheet 42, such that the cover material rests on top of the tensioning means, or above the cover material, such that the cover material depends from the tensioning means. The cover material 42 could be formed from a single piece of material, e.g. canvas, or could be comprised of a number of pieces of material attached, for example, by being sewn together. In the embodiment shown in FIGS. 8-13, the cover material 42 is sized to cover or enclose the opening or interior of the boat 12 and at least a portion of the side of the boat or fence 30 around the interior.

Figure 14:
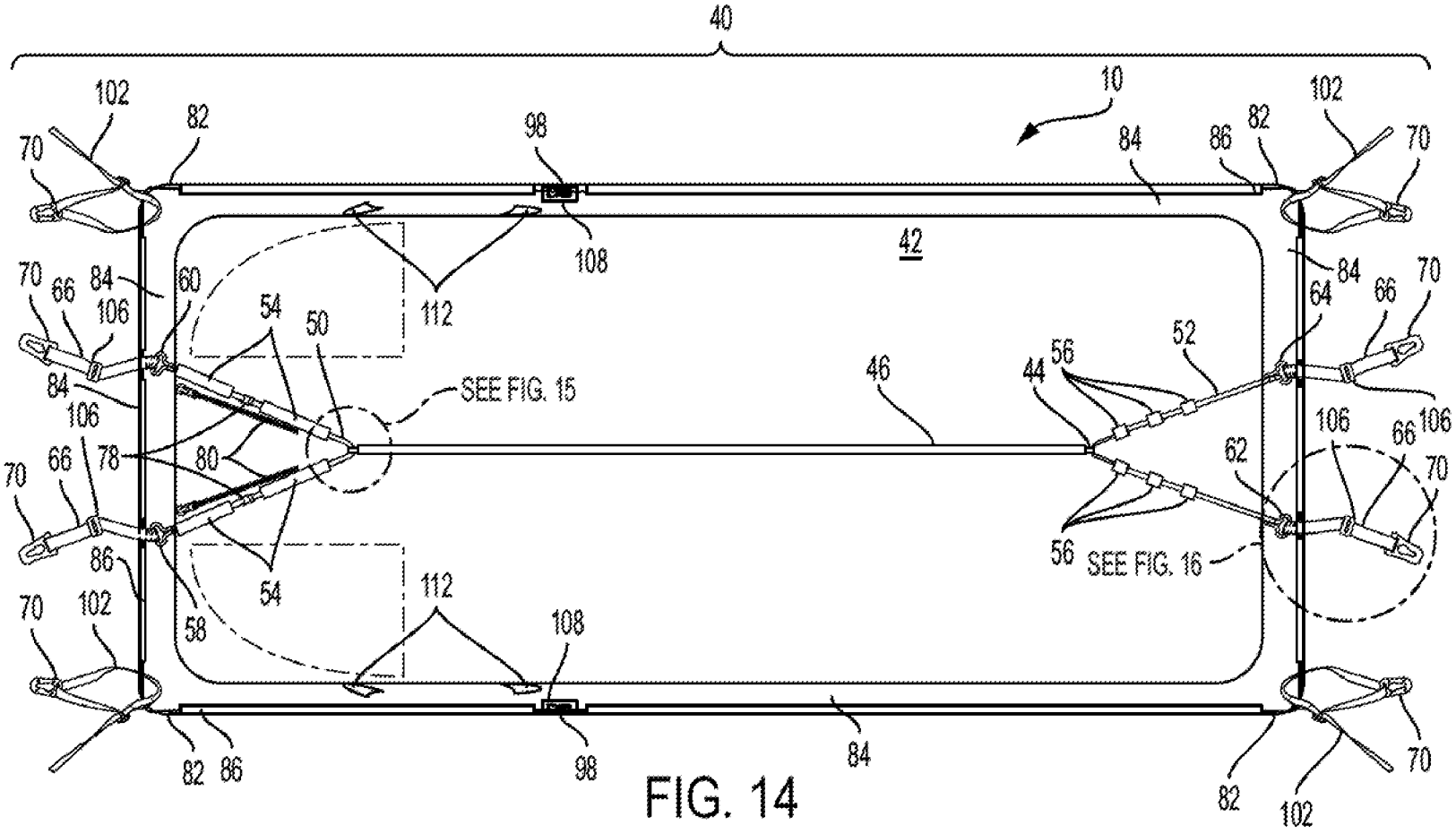
FIG. 14 is a plan view of the underside of the cover.
Figure 15:
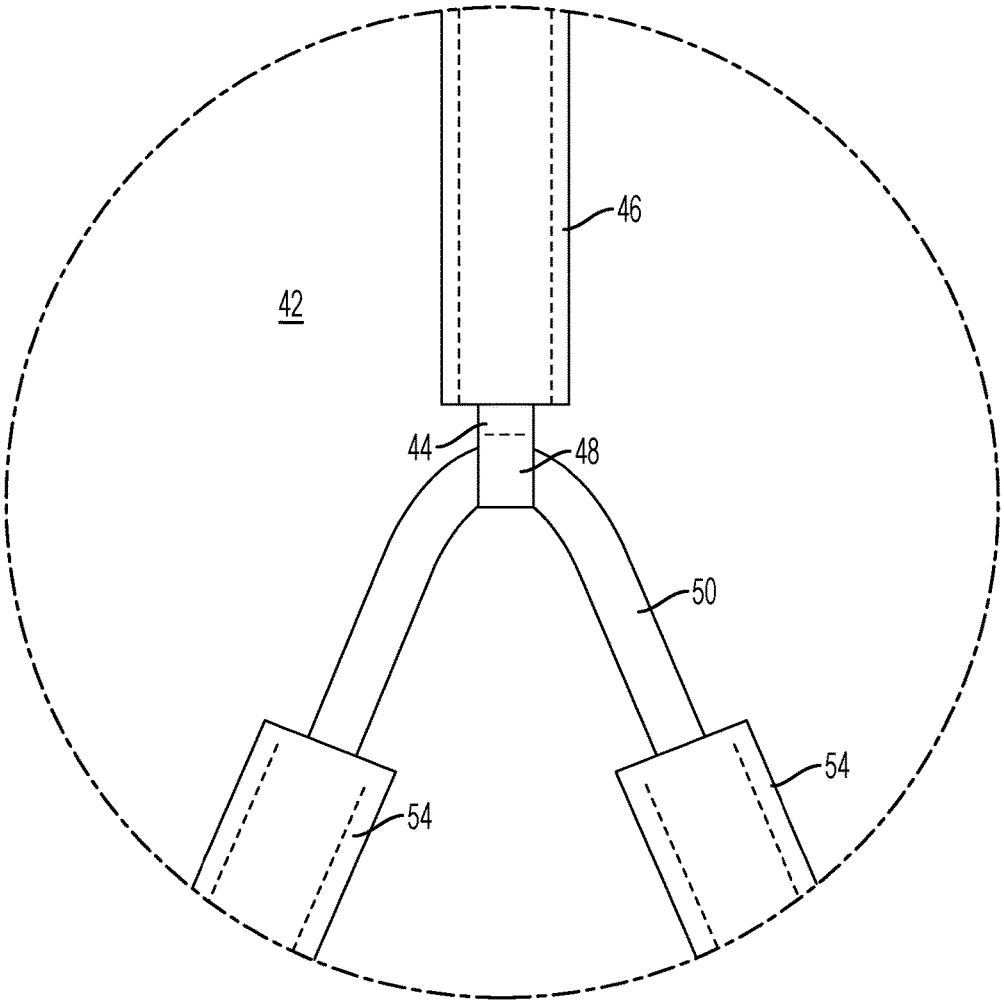
FIG. 15 is an enlarged view of the first rope and second rope of FIG. 14 taken along line 15.

In the embodiment shown in FIG. 14, the cover 10 includes a tensioning means 40 on the underside of the cover material 42. The tensioning means 40 shown in FIG. 14 includes a series of ropes, straps, webs or other cord type structures. In FIG. 14, the series of ropes are each adjustably connected at one end to the boat 12 and to each other. For example, in one embodiment, a first rope, webbing or cord 44 extends down the center of the cover material 42 and is attached to the cover material by extending through a sleeve 46 attached to the underside of the cover material. As seen in FIG. 14, the rope 44 has a loop 48 at each end. A second rope, webbing or cord 50 extends through the loop 48 at the front and a third rope, webbing or cord 52 extends through the loop 48 at the rear to connect the second and third ropes to the first rope 44. The second and third ropes also extend though sleeves 54, 56. The sleeves could be a long sleeve 54 or a series of smaller sleeves 56.

In one embodiment, the first and second ends 58, 60 of the second rope 50 and the first and second ends 62, 64 of the third rope 52 can be attached directly to the boat, such as by fasteners. In another embodiment, the ends 58, 60, 62, 64 are attached to a restraint or strap 66 that is then attached to the boat 12. For example, the first restraint 66, e.g. the bow/starboard restraint, selectively attaches a first portion of the cover 10 to the boat 12 by an adjustably attached first fastener 70. The second restraint 66, e.g. the bow/port restraint, selectively attaches a second portion of the cover 10 to the boat 12 by an adjustably attached second fastener 70. The first and second fasteners 70 can be adjusted based upon the desired length of the first and second restraint, respectively, the amount of the side of the boat 12 or fence is desired to be covered, and/or the desired amount of tension placed on the cover 10.

Figure 16:
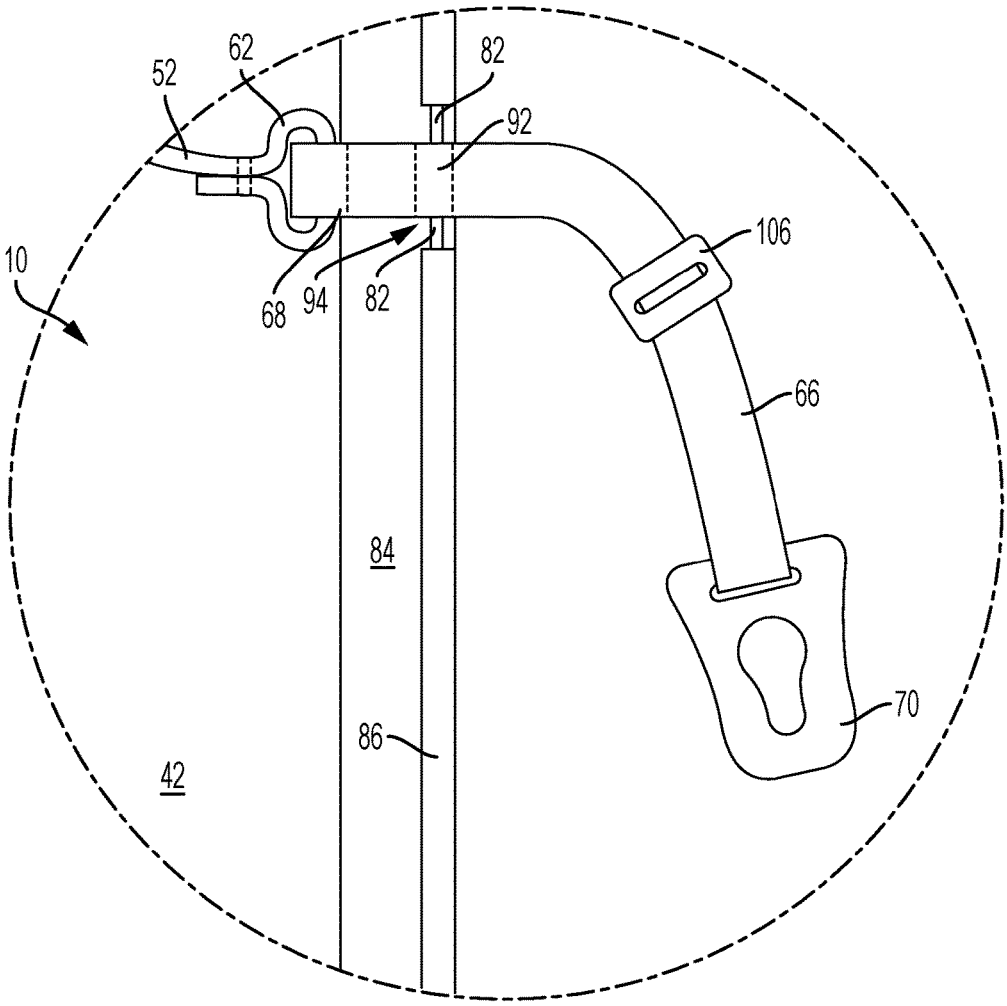
FIG. 16 is an enlarged view of the third rope and strap of FIG. 14 taken along line 16.

In the embodiment seen in FIG. 16, the restraints 66 each have a loop 68 at one end, for attaching the restraint to the second or third ropes 50, 52 and a fastener 70 for selectively attaching the restraint to the boat. Each of the first and second ends 58, 60 of the second rope 50 and each of the first and second ends 62, 64 of the third rope 52 pass through a loop 68 in a restraint 66 and are then sewn to themselves to attach the first and second ends, and thereby the ropes, to the restraints. This embodiment allows the restraints 66 to anchor the second and/or third ropes 50, 52 and, thereby, the first rope 44 such that the first tightening mechanism 78 can add tension to the first rope.

Because the cover 10 and tensioning means 40 are not tightened until after they are secured to the boat 12, each of the second and third ropes 50 and 52 are easily secured to the boat and the cover properly positioned. Additional ropes and/or straps can also be used to further hold the cover 10 to the boat 12 and provide alternative forms to the cover as desired.

The sleeves 54 and 56 as well as where the ends 58, 60, 62, 64 are attached to the boat 12 dictate the shape of the second rope 50 and third rope 52. Alternatively, a spreader plate could be used to connect a pair of ropes 50, 52 to the first rope 44. When connected to the boat 12, the second and third ropes 50, 52 each form a general "V" shape with the apex of the "V" being the point at which the second and third ropes go through the loop 48 of the first rope 44.

In the embodiment shown in FIG. 1, the seats 72 at the front and rear of the boat 12 have a space to allow egress through a front door 74 and a rear door 76. The "V" shape of the second rope 50 and third rope 52 pass through the space between the seats 72 at the front and rear over the front and rear doors 76, respectively. Because the seats 72 rise above the fence 30, passing the second rope 50 and third rope 52 between the seats, prevents the second and third rope from cutting into or deforming the seats when tension is added to the ropes and cover 10.

Figure 7:
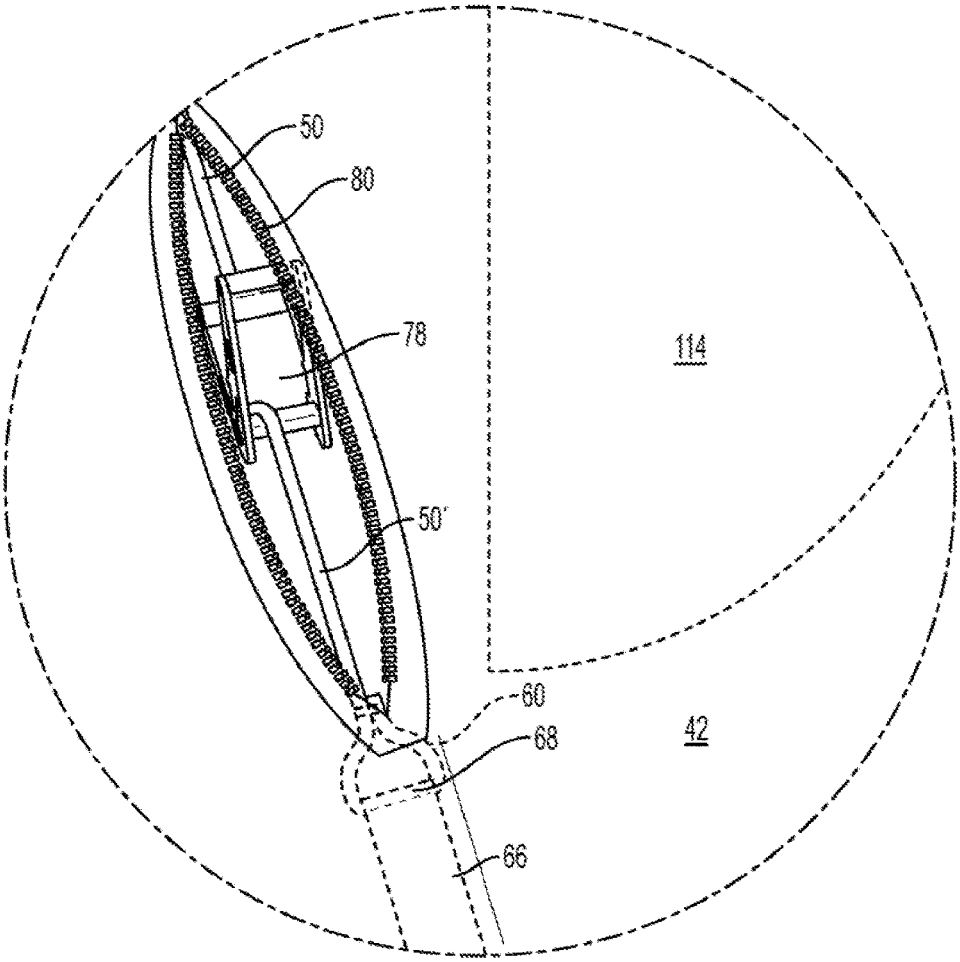
FIG. 7 is an enlarged view of an access panel of FIG. 6 taken along line 7.
Figure 8:
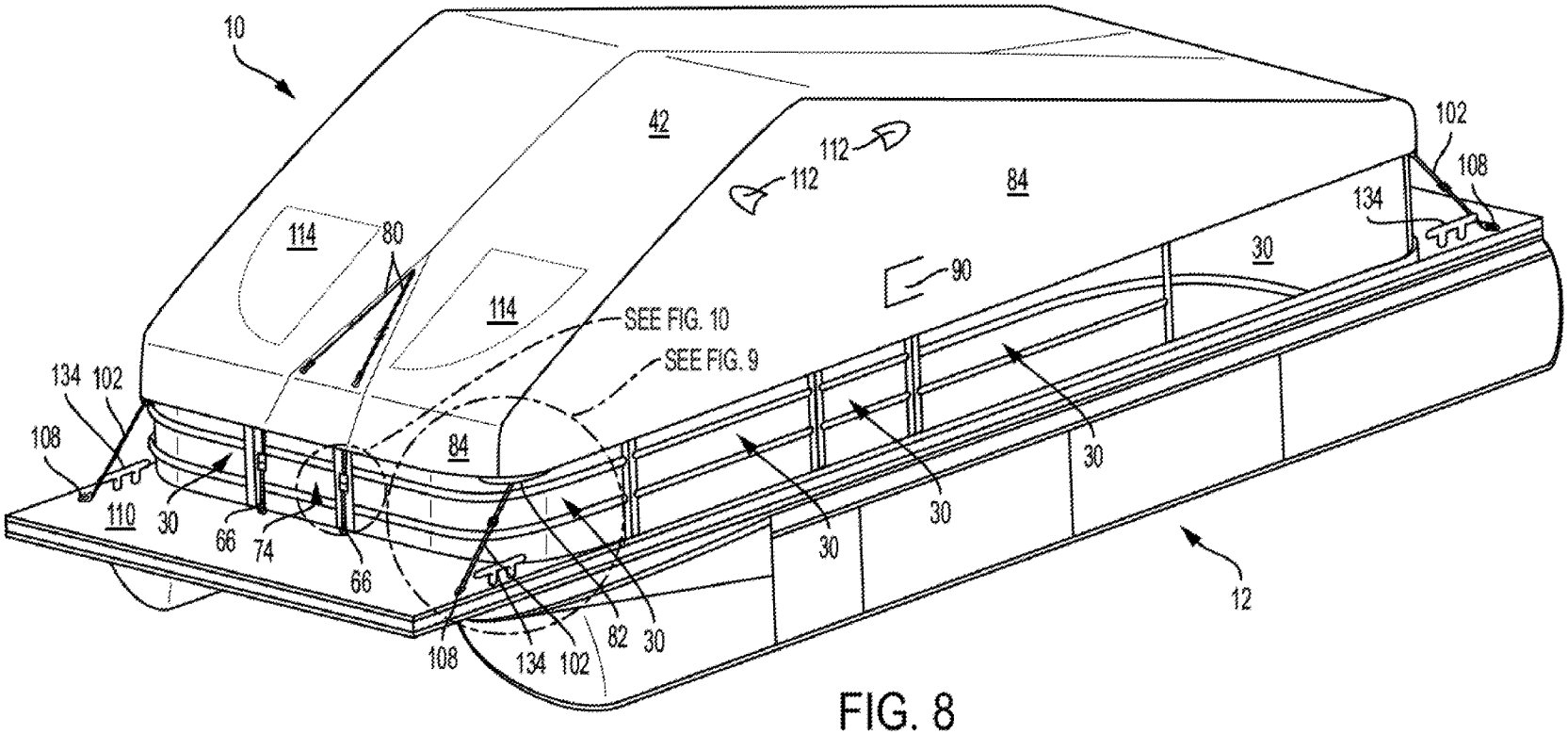
FIG. 8 is a front perspective view of the cover and boat of FIG. 5.

A tightening mechanism or device 78 is also included in the tensioning means 40, such as a ratchet, winch, gearing, pulley, etc., and, in the embodiment seen in FIG. 14, is connected to the first rope 44 by the second rope 50. After the series of ropes 44, 50, 52 are connected to the boat 12, the first tightening mechanism 78 allows the series of ropes to be tightened thereby adding tension to the cover making it taut and giving the cover 10 form, e.g. creating taut cover, for example, a number of inclined surfaces. As seen in FIG. 7, the tightening mechanism 78 may be accessible through an access panel or zippered slit 80.

In the embodiment seen in FIG. 14, the second rope 50 has a tightening mechanism 78 attached to each leg of the "V" shape. This permits access to at least one of the tightening mechanisms 78 from a dock regardless of the side the boat 12 is docked or a boat lift is attached. In one embodiment, the tightening mechanisms 78 are located at the front or bow of the cover 10 because boats are often driven in bow first, making the rear or stern of a boat 12 not as easily accessed when docked or trailered. Although two tightening mechanisms 78 are shown, more, e.g. two on each of the second and third ropes, or less, one on either of the first, second or third ropes 44, 50, 52, could be used without defeating the spirit of the invention. Similarly, the one or more tightening mechanisms 78 could alternatively or additionally be located at the rear or stern of the boat.

Figure 6:
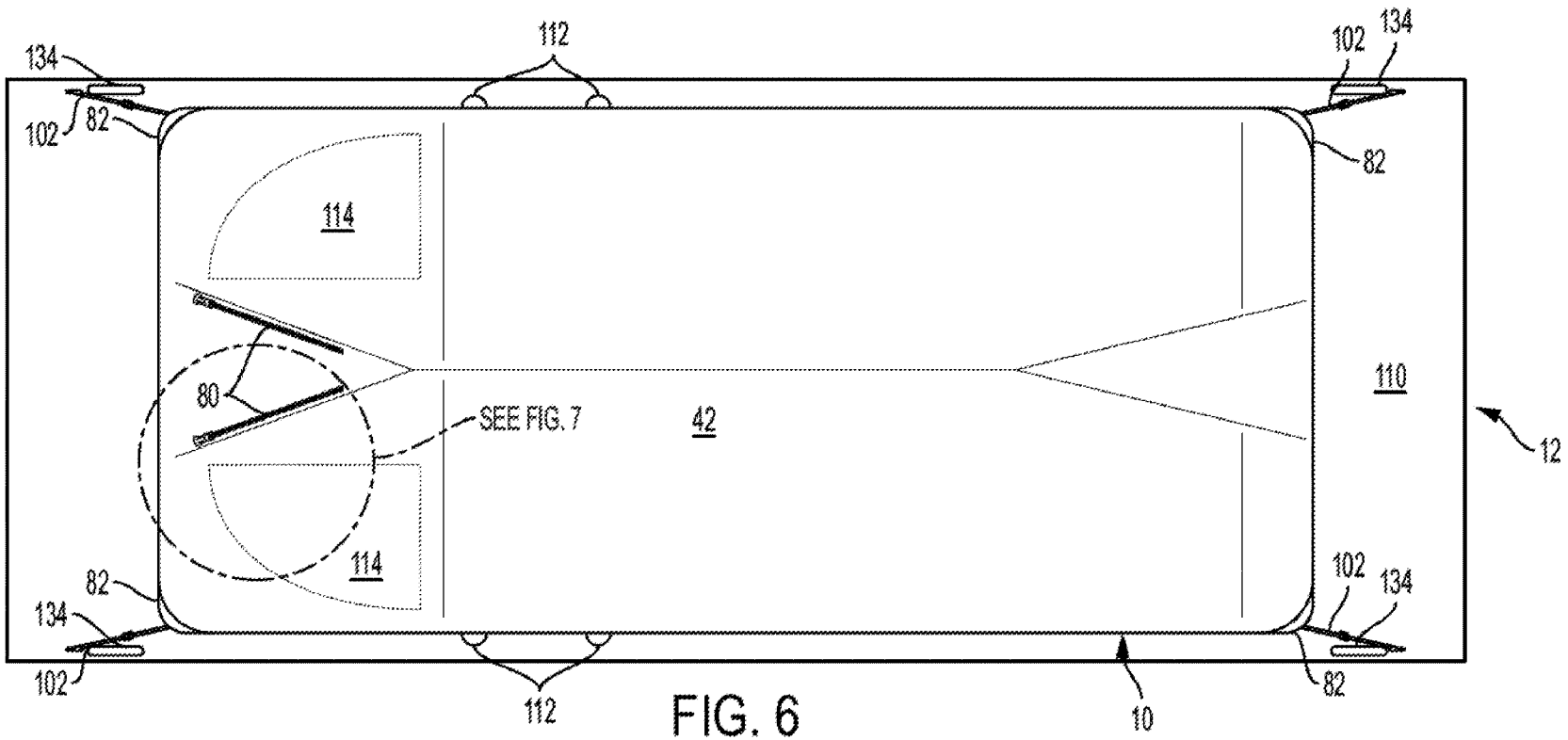
FIG. 6 is a top plan view of the cover on the boat of FIG. 5.
Figure 12:
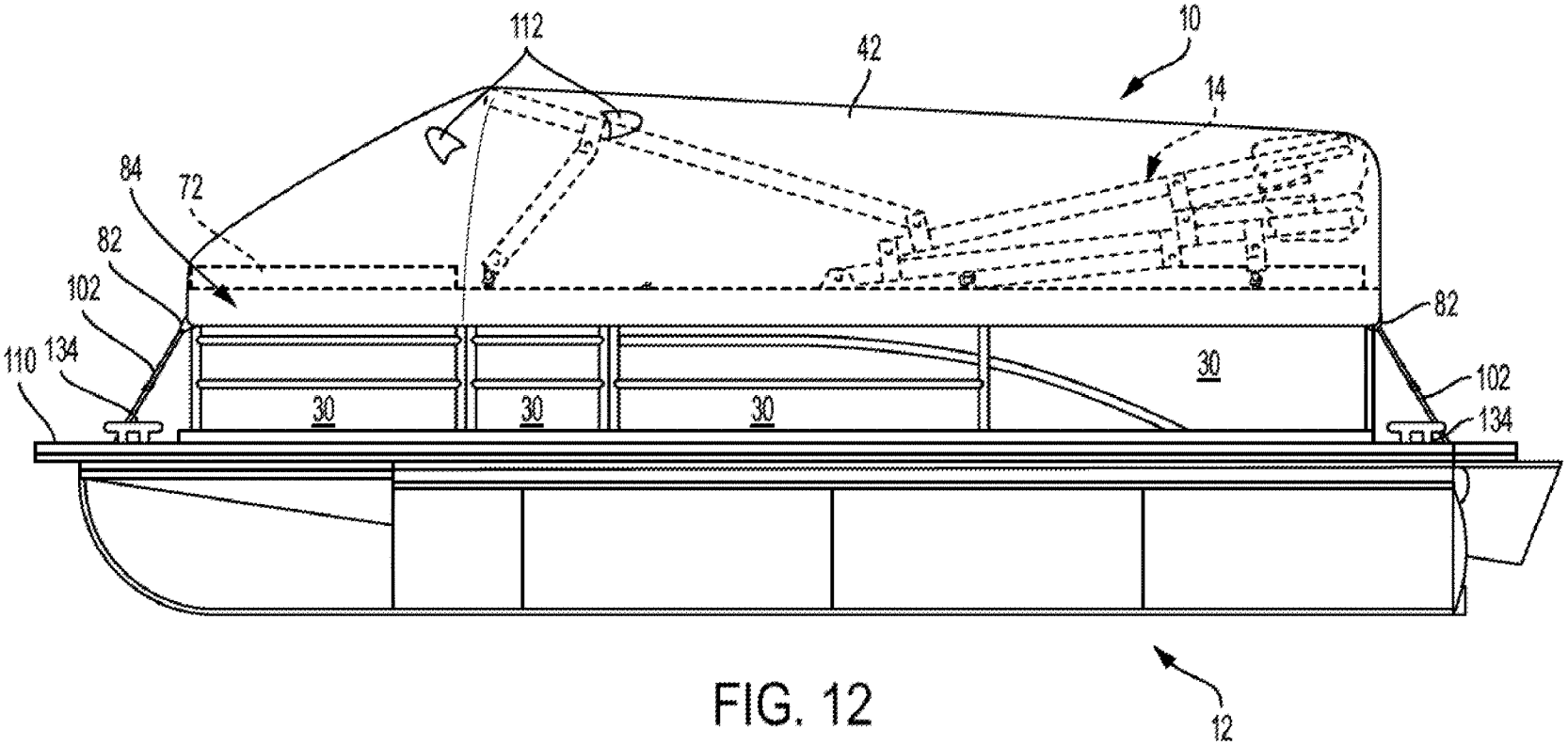
FIG. 12 is a side elevation view of the cover on the boat of FIG. 4.
Figure 13:
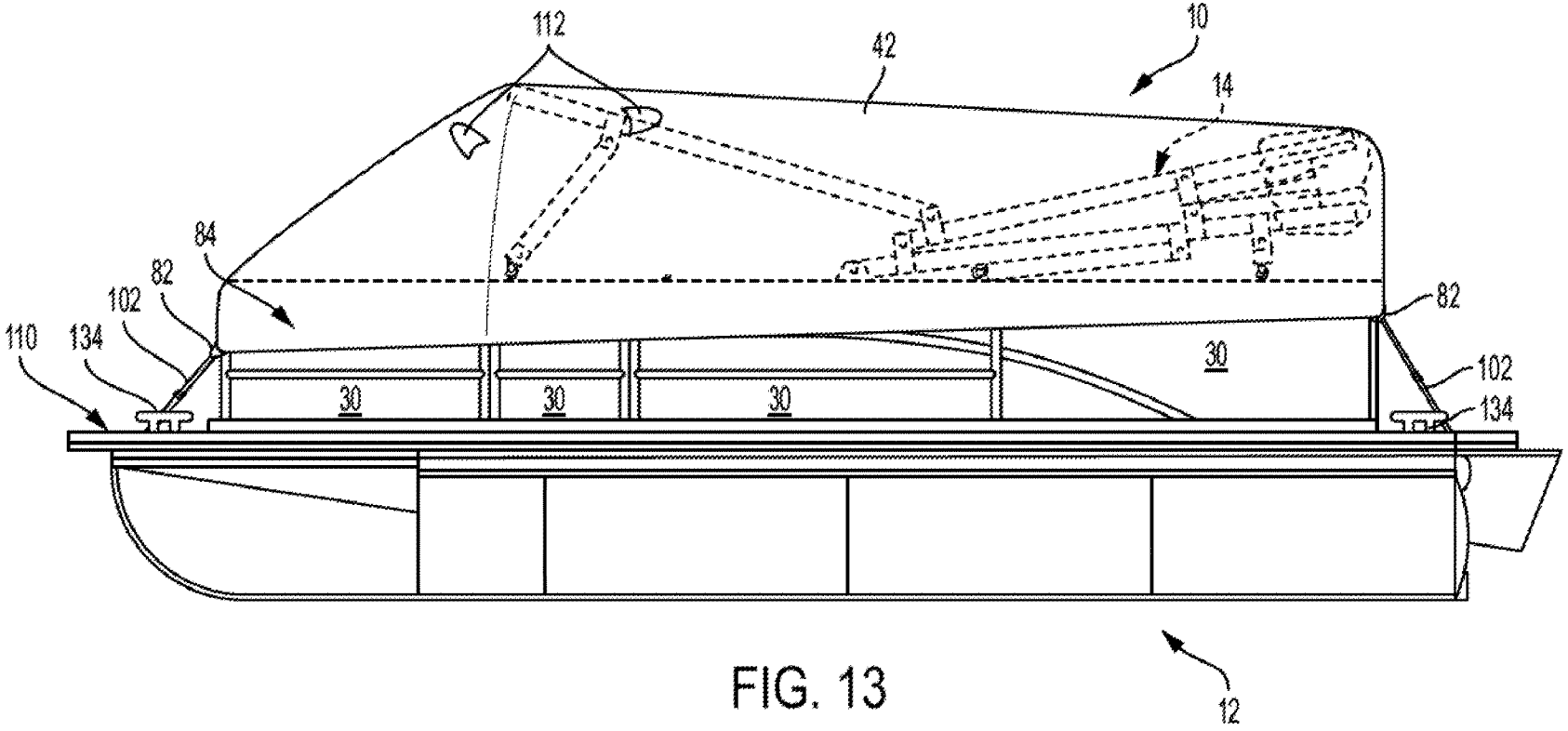
FIG. 13 is a side elevation view of the cover on a boat with a different configuration as compared with the boat of FIG. 12.

When tension is added to the ropes 44, 50, 52 such as by the tightening mechanism 78, a large amount of that tension will be transferred to the corollary bow 38. Instead of having support poles in the boat 12 to support the cover material 42, in FIGS. 8-13, the cover material is supported by corollary bow 38 and the series of ropes 44, 50, 52 which are under tension from the tightening mechanism 78. As seen in FIGS. 6 and 12-13, the first rope 44 extends over the corollary bow 38 to provide a high point for the cover material 42 and help give form to the cover, e.g. generally inclined surfaces, to enclose and cover the interior or opening of the boat. The perimeter or fence 30 of the boat 12 provides low points for the cover 10. Thus, when water is on the cover 10, such as when towing a boat 12 through rain, the water will run from a high point, corollary bow 38, to the low point, perimeter of the boat or fence 30, and run off the boat.

The cover 10 also wraps around the perimeter of the boat 12 and/or fence 30 to enclose the same. A side, ancillary or fourth rope or cord 82 is attached to the side portion 84 of the cover material 42 to generally form or fit the cover to and cover the perimeter of the sides of the boat 12 and/or fence 30 when tension is added or the side rope is tightened. In the embodiment shown in FIG. 17, the bottom of the cover 10 is folded over and sewn to create a sleeve 86 through which the side rope 82 extends to attach the side rope to the cover. However, separate sleeves could be attached to the side portion 84 without defeating the spirit of the invention.

Figure 17:
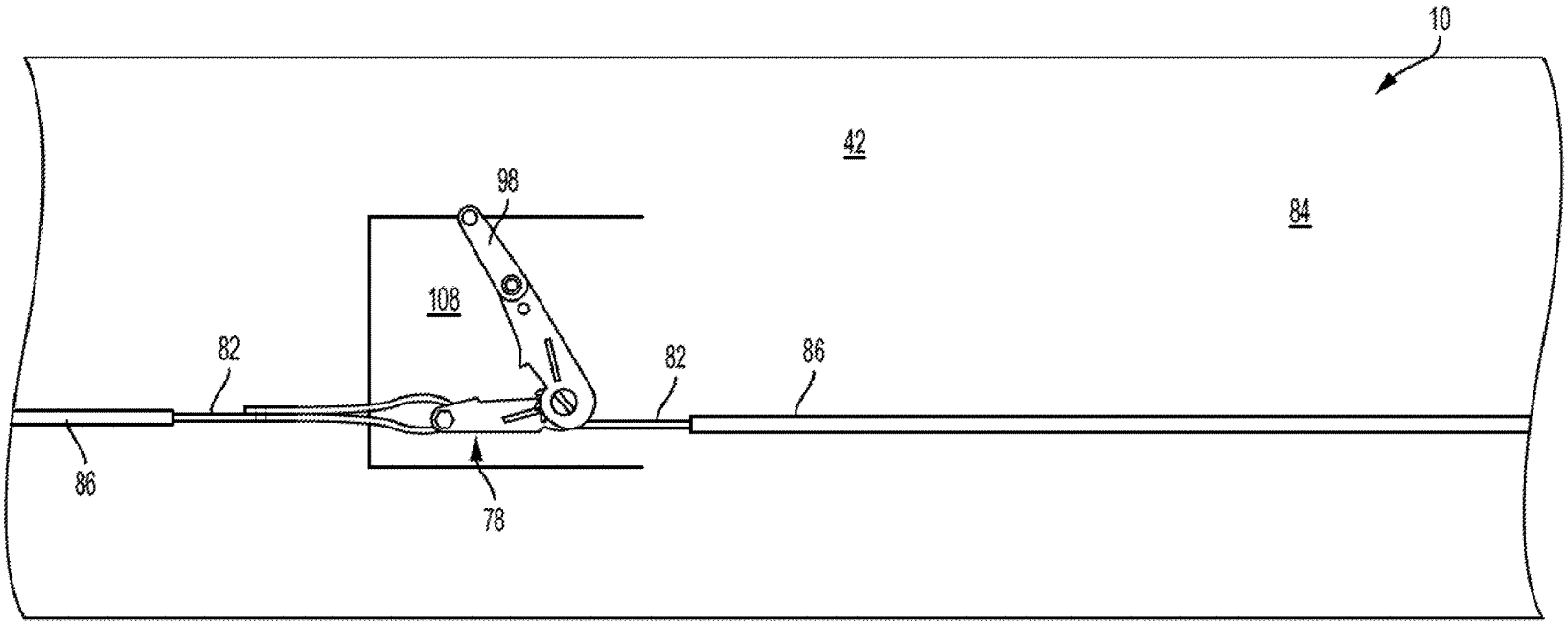
FIG. 17 is a side elevation view of the side band of a cover.

In the embodiment seen in FIG. 17, the side rope 82 also has a second or side tightening mechanism 78, such as a ratchet, winch, gearing, pulley, etc., located on the port and starboard side. More tightening mechanisms 78 could be used, e.g. on the stern, bow, aft and starboard sides, or less, e.g. on just one side, without defeating the spirit of the invention. However, having a tightening mechanism 78 on the starboard and stern of the cover 10 allows the side rope 82 to be tensioned from the dock regardless of what side the boat is docked, what side of a dock the boat lift is on or either side of a trailer and allows a more customized tension to be added to each side.

In the embodiment shown in FIG. 17, the tightening mechanism 78 is between the cover material 42 and the boat 12 and access to the tightening mechanism is provided through an access panel or flap 90. The flap 90 could have three sides with hooks matching locations on the cover 10 with loops, or any means of selectivity attaching the flap to the cover 10, for example, snaps, ties, buttons, zippers, etc.

Although the access panels 80 and 90 are shown as a zippered slit and flap, respectively, the access panels could be any selectively accessible opening and could use any means of selectivity closing the access panel, e.g. hooks and loops, snaps, ties, buttons, zippers, etc. or have no such selective closing means. Access panels 80 can also be included on the cover 10 for access to other features and structures of the boat 12.

In one embodiment, as seen in FIG. 16, the side rope 82 also passes through openings 92 in the restraints 66 to connect the side rope to the restraints. At each restraint 66 location, the sleeve 86 stops to create a cut-away portion 94 to expose the side rope 82 such that the side rope can extend through the opening 92 and then back into the sleeve. As the restraints 66 are tightened down, such as by the tightening mechanism 78, e.g. ratchet, the restraints 66 will add tension to the series of ropes 44, 50, 52 to give form to the cover 10 and pull down the side rope 82, potentially out of the cut-away portion 94.

Although sleeves 46, 54, 56, 86 are shown and described to attach the ropes 44, 50, 52, 82 to the cover 10, other means for attaching are known in the art, for example, loops, ties, holes, between two cover materials 42, etc., the use of which would not defeat the spirit of the invention. One or more sleeves or other means for attaching could also be sized such that it would not allow the fastener 70 and strap to pull through it. Such a configuration prevents the ropes 44, 50, 52, 82 from having to be rethread through the sleeves, prevents the ropes from becoming tangled and generally keeps the cover 10 in condition for use.

The tightening mechanisms 78 and 98 are shown in FIGS. 7 and 17 as ratchets. For example, as seen most clearly in FIG. 7, a ratchet 98 is connected at one end to the second rope 50 and at the other end to the restraint 66 by, for example, another portion of second rope 50'. As the second rope 50 is pulled through the ratchet 98, the portion of the second rope between the ratchet 98 and the other end of the second rope 50, the bow/starboard end, becomes shorter. In the cover embodiment seen in FIG. 14, as the second rope 50 becomes shorter it pulls forward, or towards the bow, and adds tension to the first rope 44. The first rope 44 in turn pulls and adds tension to the third rope 52 and, thereby, the bow and stern restraints 66 and the first, second and third ropes 44, 50, 52 are tightened or tensioned. The loops 48 allow the first, second and third ropes 44, 50, 52 to adjust with respect to one another as the tensioning means 40 becomes tensioned. As the first, second and third ropes 44, 50, 52 start to become tightened, the ropes and cover material 42 will raise off the boat 12 and be taut and supported with little to no visible sagging, thereby giving the cover 10 support and form. The first, second, third ropes 44, 50, 52, hold the cover 10 to the boat 12 and give form to the cover enabling water to effectively run off the covered boat 12.

Another or second tightening mechanism, ratchet 98 is shown in FIG. 17 attached at each end to an end of the side rope 82. As the side rope 82 is pulled through the ratchet 98, the side rope becomes shorter. As the side rope 82 becomes shorter it compresses or holds the side portion 84 to the fence 30 of the boat 12.

Some boats 12 have a fence 30 with rounded corners as seen in FIGS. 1 and 6. If too much compressive force is applied by the ratchet 98 and side rope 82, the corners of the fence 30 could be overly compressed, bent, broken or otherwise damaged. To prevent the corners from being damaged, e.g. from over compression, while at the same time allowing the cover 10 to be fitted to the boat 12 and/or fence 30, corner straps 102 are attached to the side rope 82 at the corners of the boat.

Figure 9:
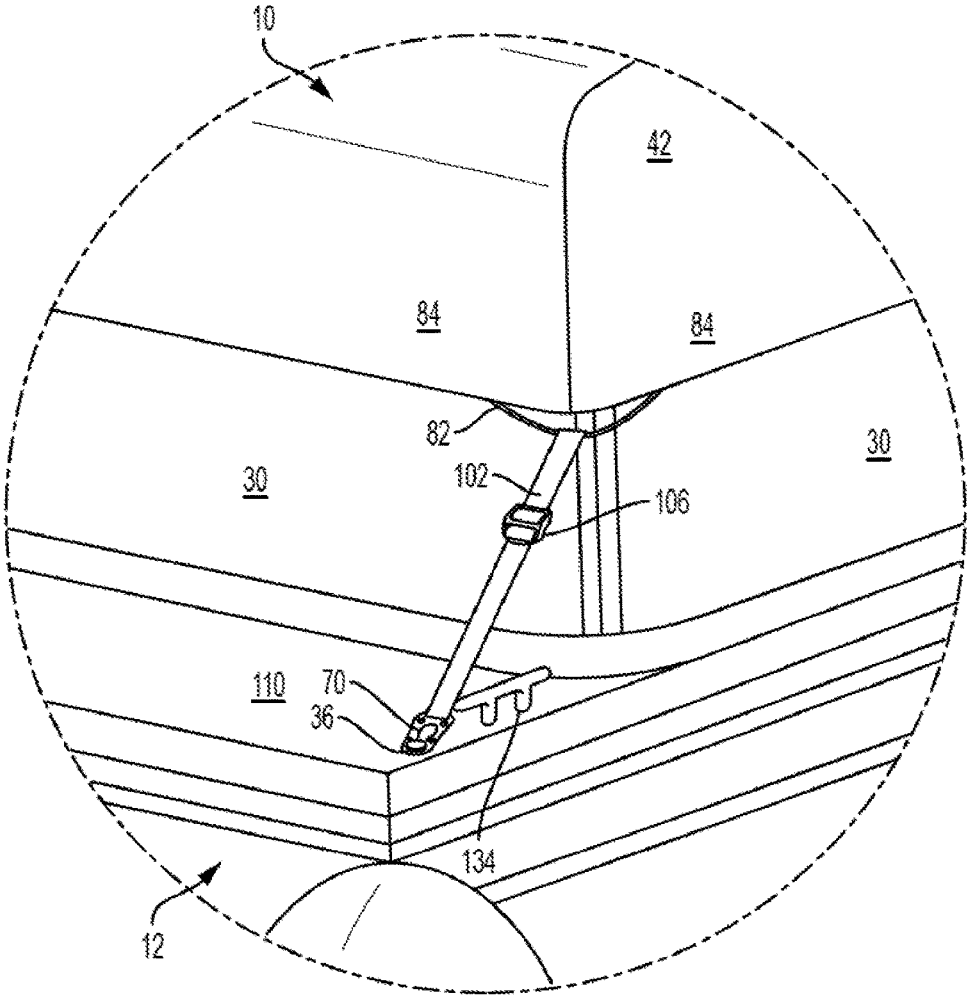
FIG. 9 is an enlarged view of a corner strap of FIG. 8 taken along the line 9.

In the embodiment shown in FIG. 9, the sleeves 86 are stopped to form a gap at the corners exposing the side rope 82. A ladder lock 106 connects the corner or side strap 102 to the side rope 82 at the corner and a fastener 108 is attached to the corner strap to attach the corner strap to the boat 12. In the example shown in FIG. 9, the corner strap 102 is attached to the deck 110 of the boat 12. The corner strap 102 prevents the side rope 82 from putting compressive forces on the corner of the fence 30 by holding the side rope away from a portion of the fence when the side rope 82 is ratcheted down and tightened as described above. The ladder lock 106 also allows the corner strap 102 to be adjusted during installation so that it is in the correct arrangement for future uses or to be adjusted as the covered is installed on different vehicles or configuration of vehicles.

Figure 10:
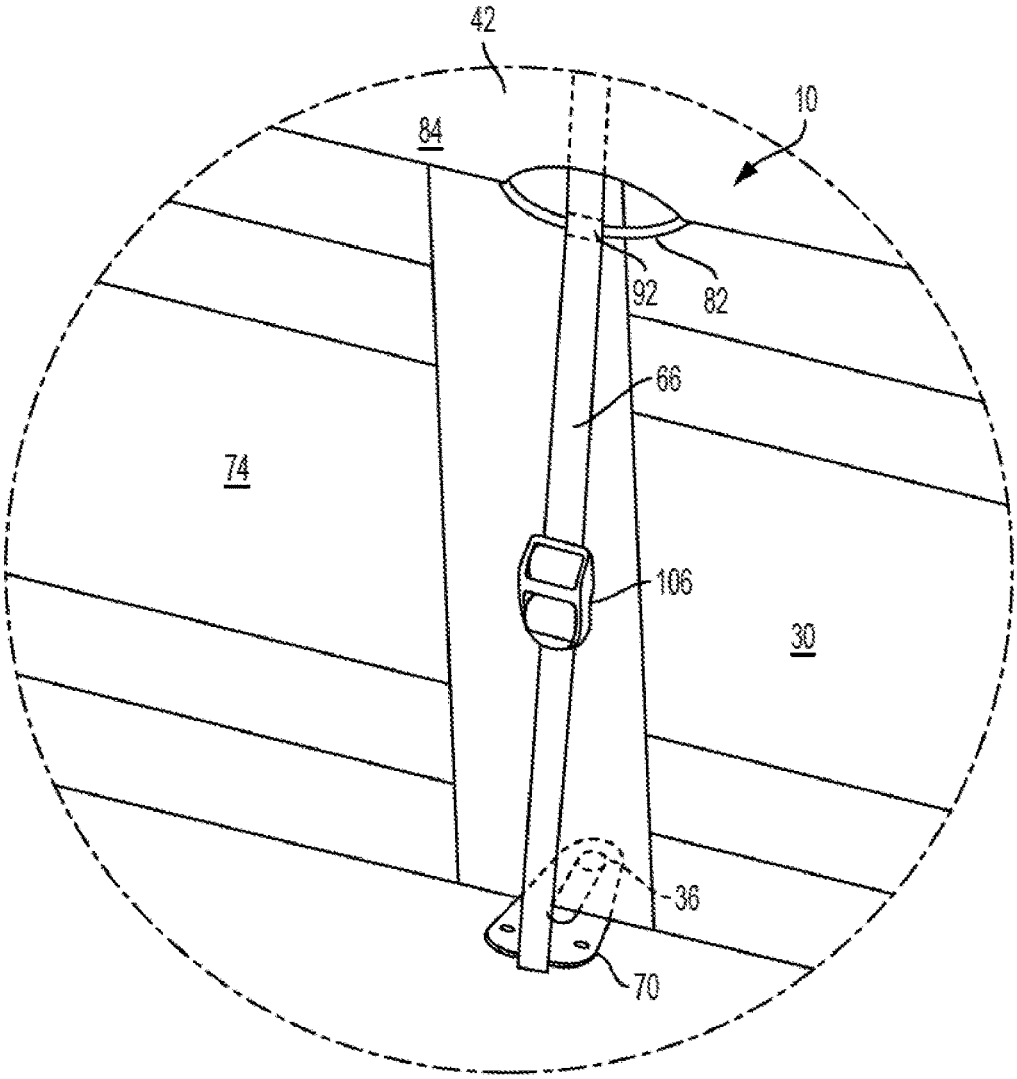
FIG. 10 is an enlarged view of a strap of FIG. 8 taken along the line 10.
Figure 11:
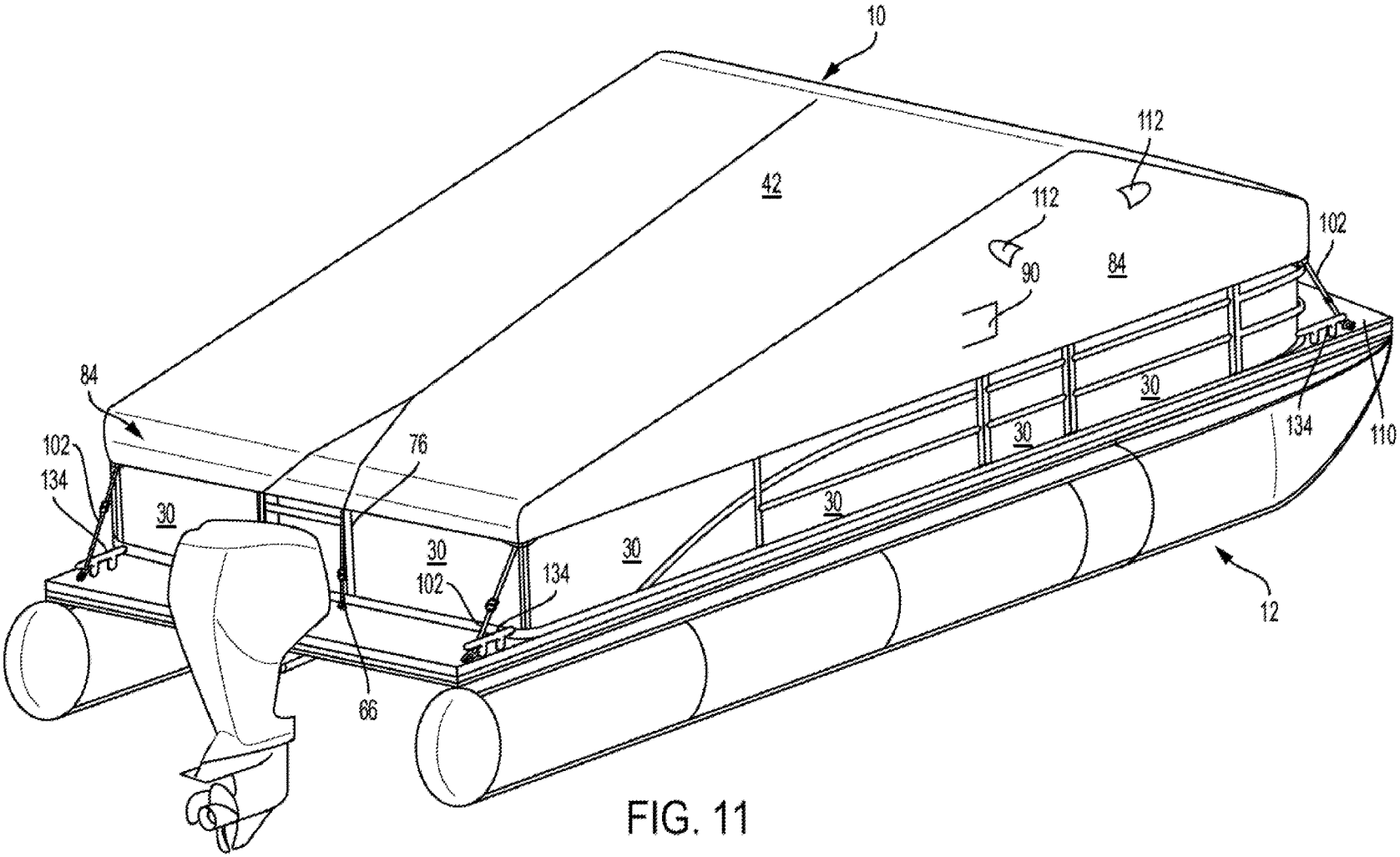
FIG. 11 is a rear perspective view of the cover and boat of FIG. 8.

Although the ropes 44, 50, 52, restraints 66 and corner straps 102 are shown as being attached to one another and/or fasteners 70 by ladder locks 106, loops 48, openings 92 and stitching, other means for attaching are known in the art, for example a snaps, ties, clips, knots, glue, rivets, braiding, etc., the use of which would not defeat the spirit of the invention. The embodiments shown in FIGS. 8-14 and 16 illustrate the use of a fastener 70, such as a web clip attached to a DowcoLok® quick connect button 36, which is attached to the boat 12. For example, as seen in FIG. 9, the corner strap 102 has a one end connected to a fastener 70, e.g. web clip, for attaching the corner strap to a DowcoLok® quick connect button 36 attached to the deck 110 of the boat 12. FIG. 10 similarly shows a fastener 70, web clip, attached to the restraint 66 and latched onto a DowcoLok® quick connect button 36 mounted on the underside of the fence 30 thereby connecting the restraint to the boat 12. By using fasteners 70 and, for example, quick connect buttons 36, the cleats 134 of the boat remain unobstructed and can be used for tying the boat to the dock. The DowcoLok® quick connect button 36 could be mounted anywhere convenient, for example of the deck 110, another location on the rail 30, etc.

As seen by comparing FIGS. 12-13, the same cover 10 can be used on multiple configurations of the boat 12. For example, the boat 12 in FIGS. 8-12 is a pontoon boat with seats 72 along the fence 30 that extend above the top of the fence 30 as seen in FIG. 12. In FIG. 13, the boat 12 has no seats 72 along the fence 30 and therefore, the cover 10 can be pulled further down the fence at the bow or front and closer to the deck 110 of the boat.

Although the tensioning means 40 and tightening mechanism 78 are shown in under the cover 10, they could also be located above the cover. A clip, hook, carabineer or other known means for attaching the cover 10 to the frame 14 or other supporting structure could also be used.

In another embodiment, the loops 48 of the first rope 44 can be replaced with a pulleys. For example, the first rope 44 can be attached at one or both ends to a fixed support of a pulley. The pulley can be connected or joined to the cover material 42 by any known means such as, for example, by being enclosed in a pocket in which the supports of the pulley are in a fixed relationship with the pocket. A second rope 50 can be attached at one end 58 to one bow/starboard corner of the boat 12, extend up to and around the pulley and then back towards the bow/port corner where its second end 60 is attached to a tightening mechanism, for example a ratchet. A third rope 52 can be attached at one end 62 to one stern/starboard corner of the boat 12, extend up to and around another pulley and then back towards the stern/port corner where a second end 64 is attached.

As the second rope 50 is pulled through the ratchet 98, the second rope becomes shorter and the pulley and first rope 44 are pulled towards the bow of the boat 12. As the first rope 44 is pulled towards the bow of the boat 12, the third rope 52 is pulled towards the bow and the ropes are tightened or tensioned thereby giving the cover 10 support and form.

Often a cover 10 is put on a boat 12 after the boat has been used. This can mean that the footwell of the boat includes a lot of moisture and may even be wet from, for example, occupants getting out of the water and into the boat. It is therefore desirable to draw the moisture out of the boat 12. To this end, the cover 10 may also include one or more vents 112 as seen in the embodiment shown in FIGS. 6-14. The shape, size and location of the vents 112 create a vacuum when the boat 12 with cover 10 is being towed. When a vacuum is created, air is drawn out of the interior of the boat 12 thereby helping to draw moisture out of the boat. The vacuum also helps the cover 10 to more snuggly fit or conform to the contours of the boat 12 and corollary bow 38, thereby making the boat with cover more aerodynamic and fuel efficient to tow and prevents the cover from flapping in the wind, which can damage the cover.

In some embodiments, it may be desirable to provide further support for the cover 10. For example, depending on the size of the cover 10, size and configuration of the boat 12, location of the frame 14 and/or type of cover material 42, the cover, even when properly tensioned, may have some depressions where water may tend to pool. To prevent this pooling, pockets 114 may be created in the cover 10 by attaching, e.g. sowing, additional material to the cover material 42, and could also be filled with a material, e.g. foam, or additional ropes used to give that area of the cover more rigidity, and reduce pooling and/or help form the cover. In the embodiment shown in FIG. 6, a quadrant shaped material, e.g. canvas, is sewn onto the cover material 42. The space or pocket between the quadrant shaped material and the cover material 42 is filled with a foam material.

Figure 18:
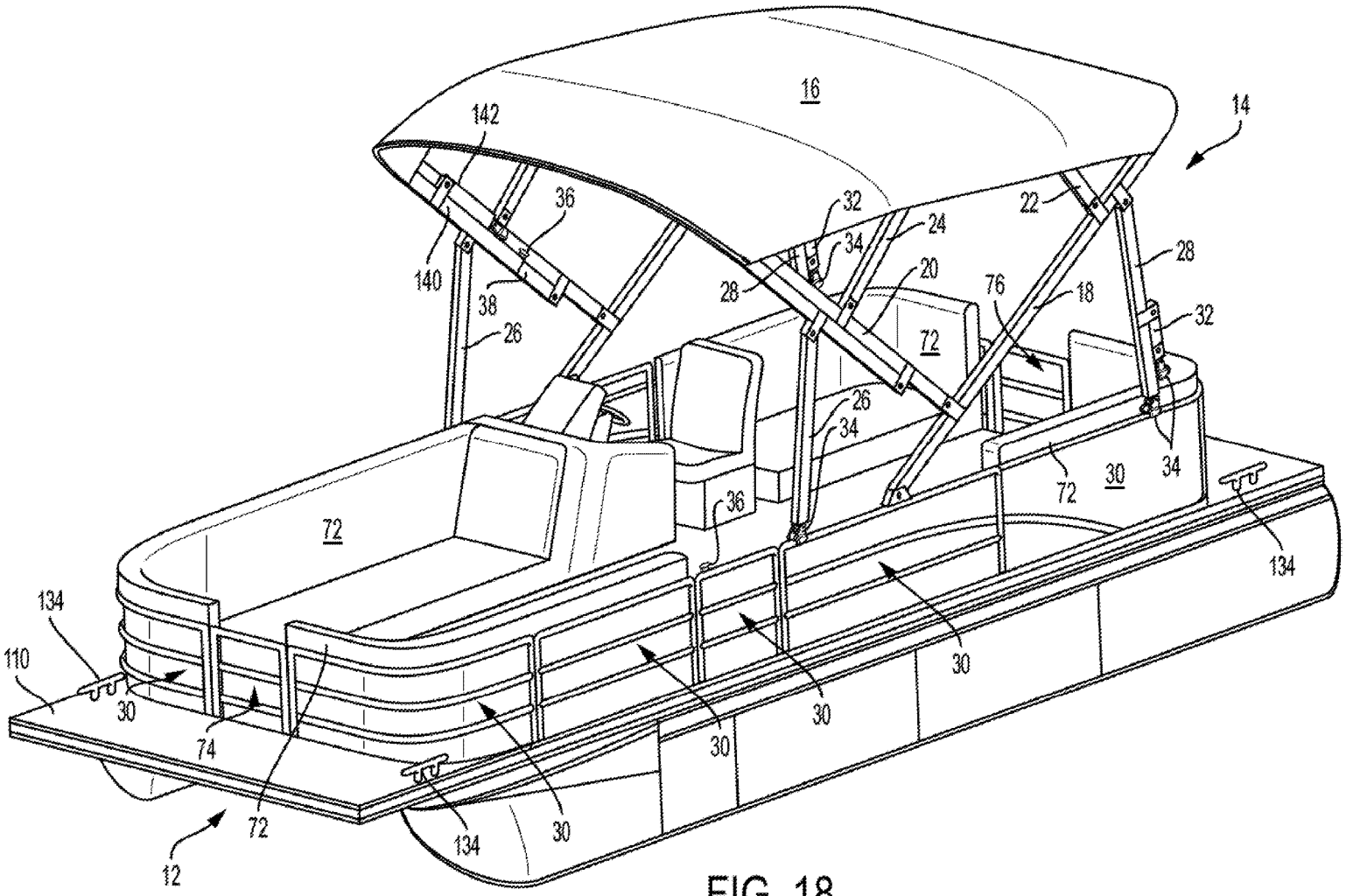
FIG. 18 is a perspective view of a boat with an alternative embodiment of a bimini in a fully deployed position.
Figure 19:
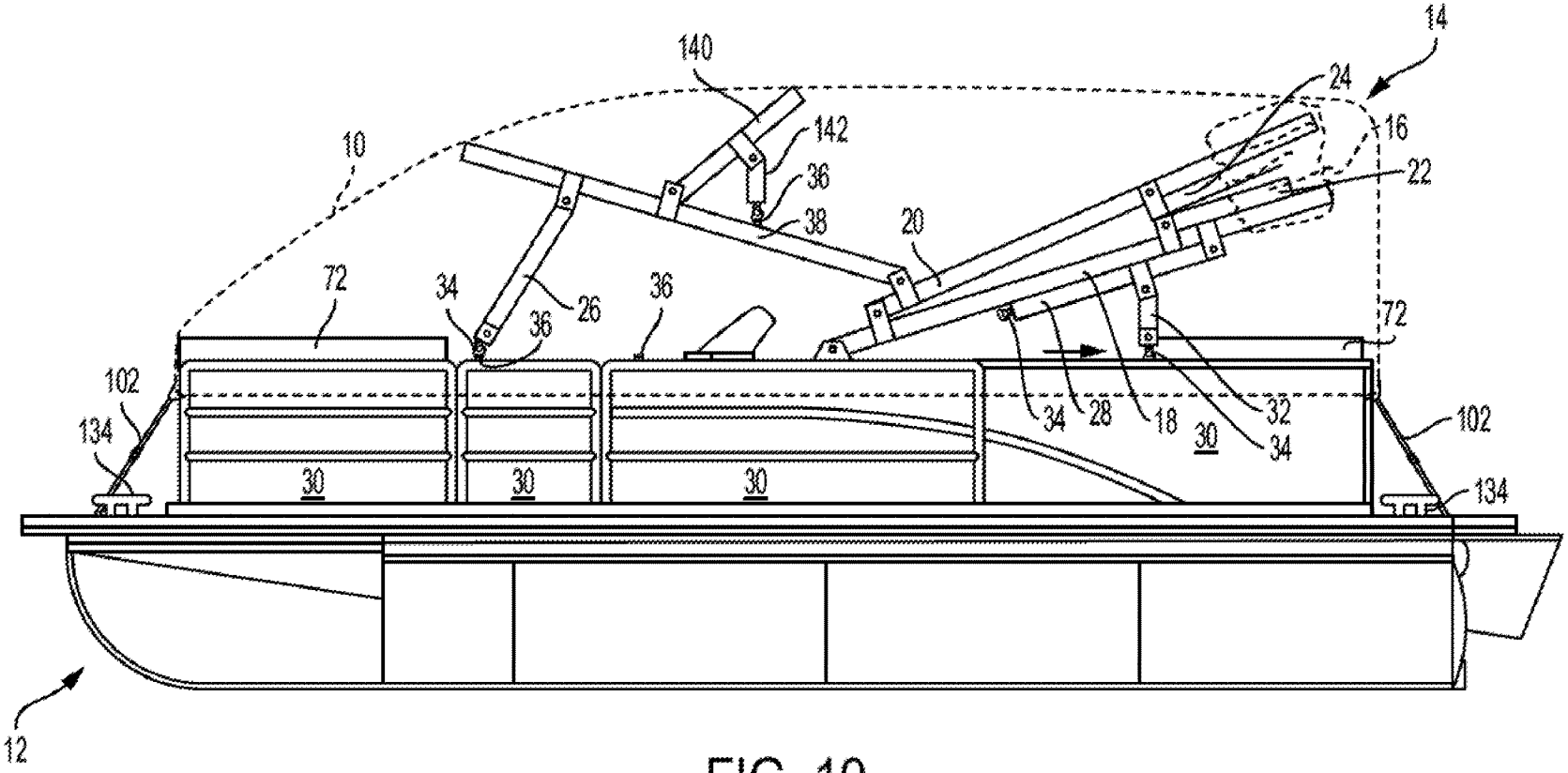
FIG. 19 is an elevation side view of the boat in FIG. 18 with the alternative embodiment bimini in a trailered position and a bow in a position to support a cover.

If more support or a different shape is desired for the cover 10, and additional bow may be used. For example, in one embodiment seen in FIGS. 18-19, a second corollary bow or a second one of the number of structural members 140 is pivotally connected to the corollary bow 38 or is otherwise able to be disengaged from the structure 14. When the frame 14 is in the fully deployed position, as seen in FIG. 18, both the corollary bow 38 and second corollary bow 140 are held in the pocket of the canopy. When the frame 14 is in the trailering position, as seen in FIG. 19, the second corollary bow 140 is rotated out of line from the corollary bow 38, in the embodiment shown, to a position generally perpendicular to the corollary bow 38. Attached to the second corollary bow 140 is a support arm 142. The support arm 142 rotates away from the second corollary bow 140 and attaches to the corollary bow 38, e.g. by a clip 34 at the bottom of the second corollary bow and a button 36 attached to the corollary bow to secure the second corollary bow in position. Because the second corollary bow 140 is not in line with the corollary bow 38, the support arm 142 is able to rotate out of line with the second corollary bow to the corollary bow. When the cover 10 is on the frame and the second corollary bow 140 is in position, the cover will form inclined surfaces to shed water.

Figure 20:
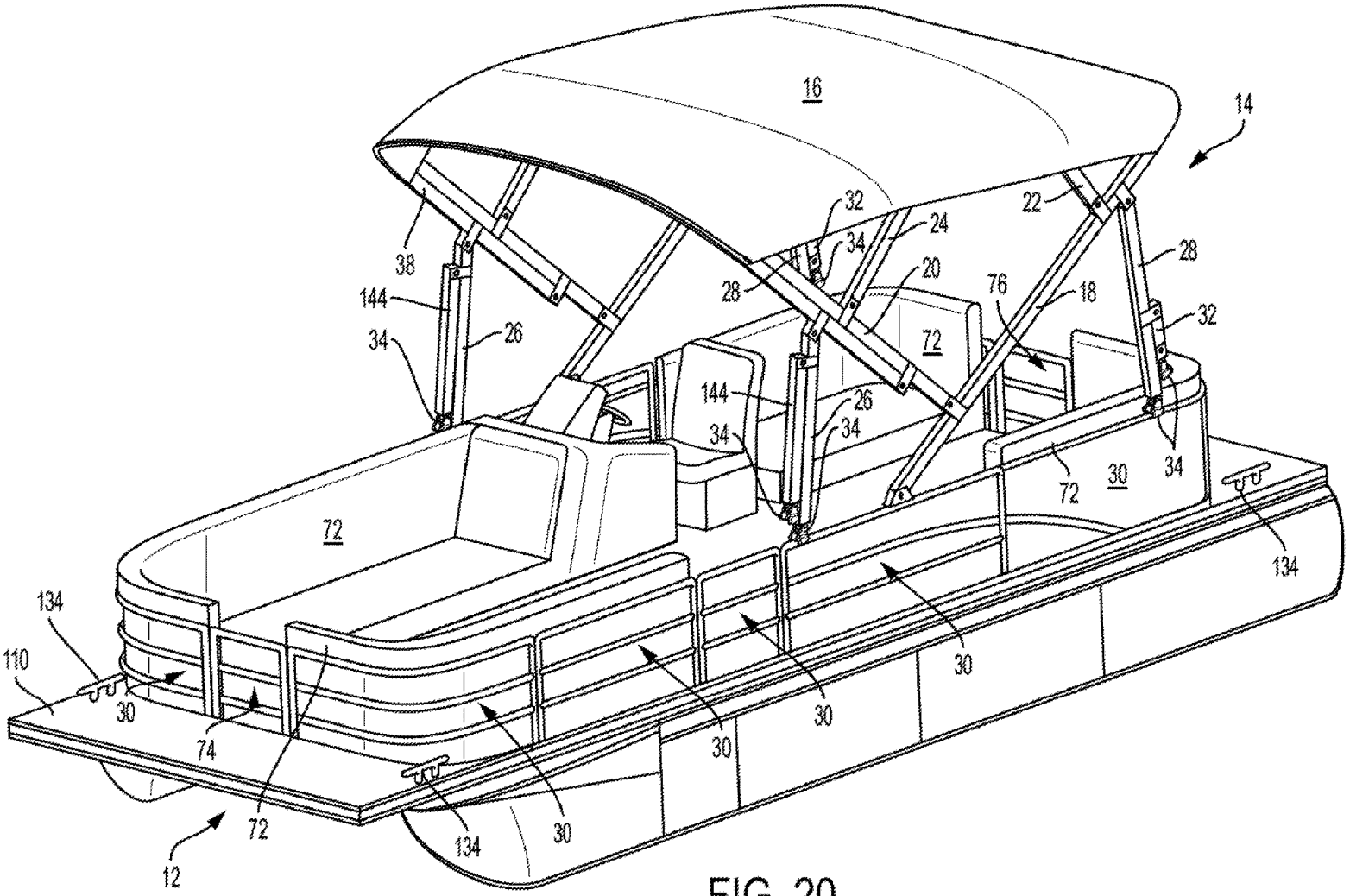
FIG. 20 is a perspective view of a boat with an alternative embodiment of a bimini in a fully deployed position.
Figure 21:
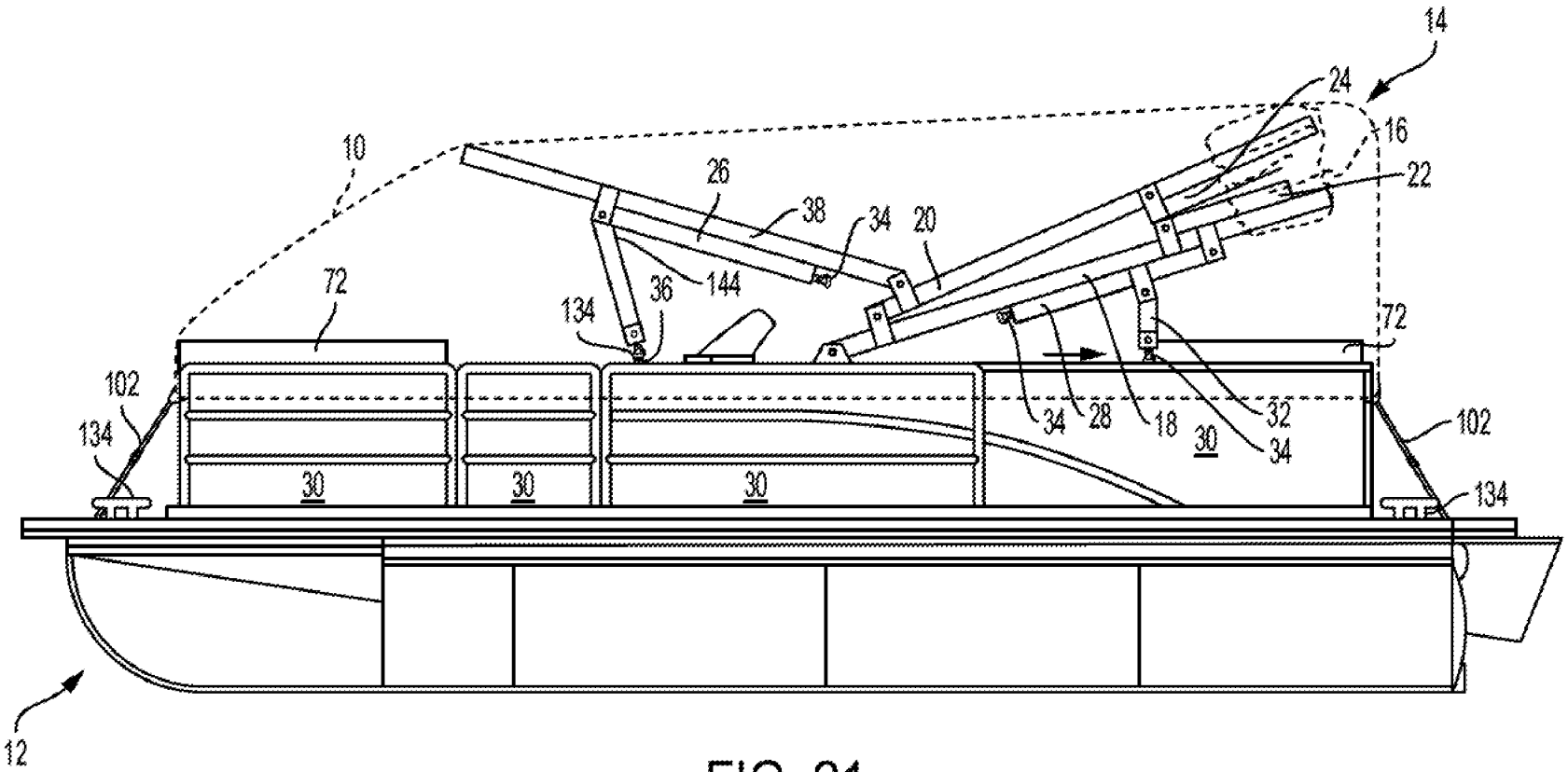
FIG. 21 is an elevation side view of the boat in FIG. 18 with the alternative embodiment bimini in a trailered position and a bow in a position to support a cover.

Depending on the size of the frame 14 and vehicle 12, a part of the frame may come into contact with the vehicle at an undesirable location. For example, as seen in FIG. 5, the front strut 26 connects to the rail 30 of the boat 12 at a door. This connection may be undesirable because the door may be a weaker location of the rail 30 and more susceptible to failing and/or damage, because it prevents entry and exit of the boat when the frame 14 is in the tailored position or any other reason. In one alternative embodiment, a second front strut 144 is used as seen in FIGS. 20-21. In this embodiment, the second front strut 144 is rotatably connected to the front strut 26. When the frame 14 is in the fully deployed position, as seen in FIG. 20, the longer strut, the front strut 26, is used. When the frame 14 is in the tailoring position, as seen in FIG. 21, the shorter strut, the second front strut 144 is used. In this embodiment, both the front strut 26 and the second front strut 144 attach to the same point on the boat 12, e.g. button 36, to avoid the need for two different connection points, although two or more connections points could be used.

At least one company, Taylor Made Group, LLC, has started using tubes of a bimini top to support a canvas. One model offered by Taylor Made Group, LLC, doing business as Ameritex Fabric Systems is called the MDC Cover System.

Figure 22:
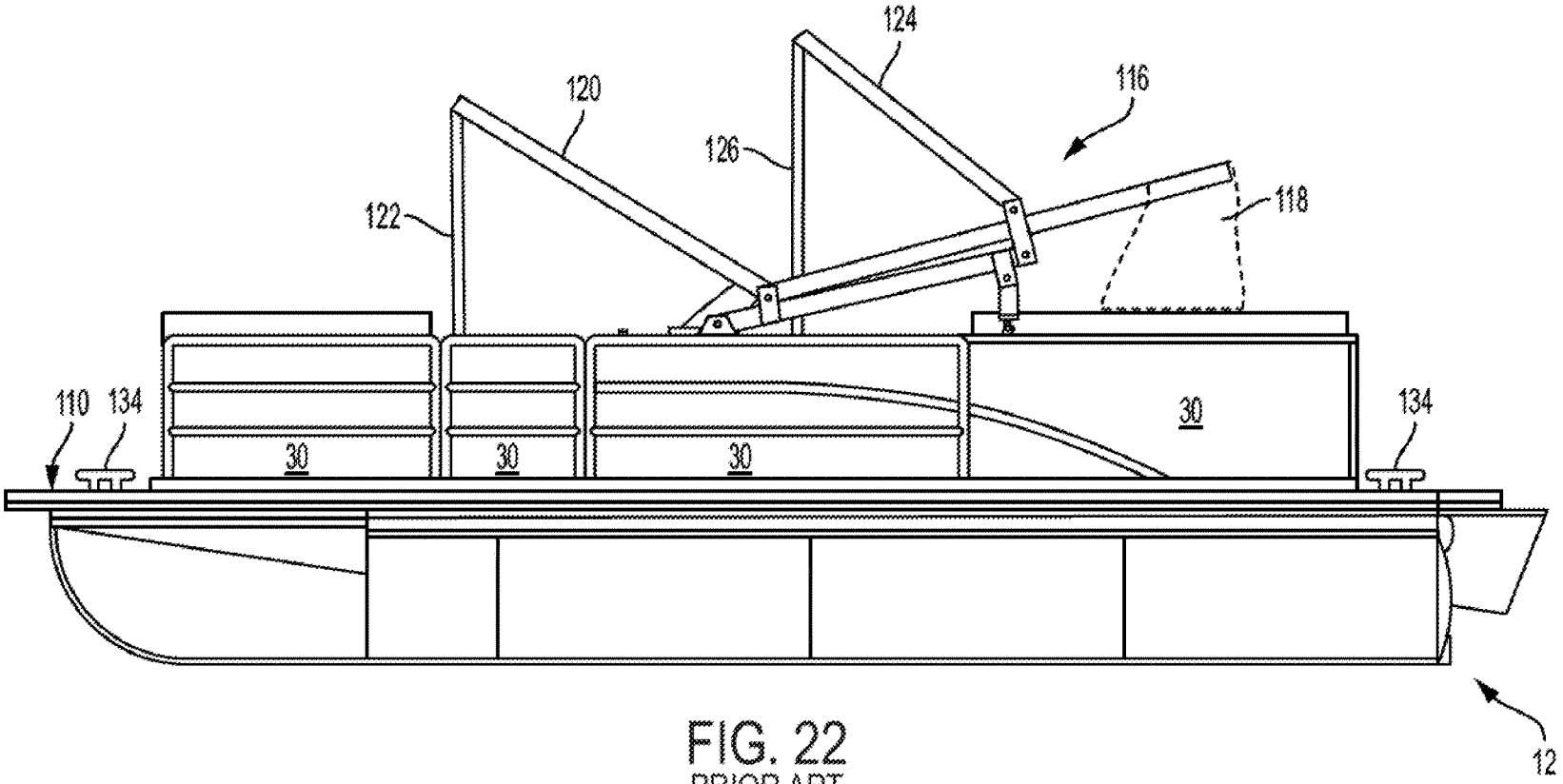
FIG. 22 PRIOR ART
FIG. 22 is an elevation side view of a boat with a prior art bimini in a ready position.
Figure 23:
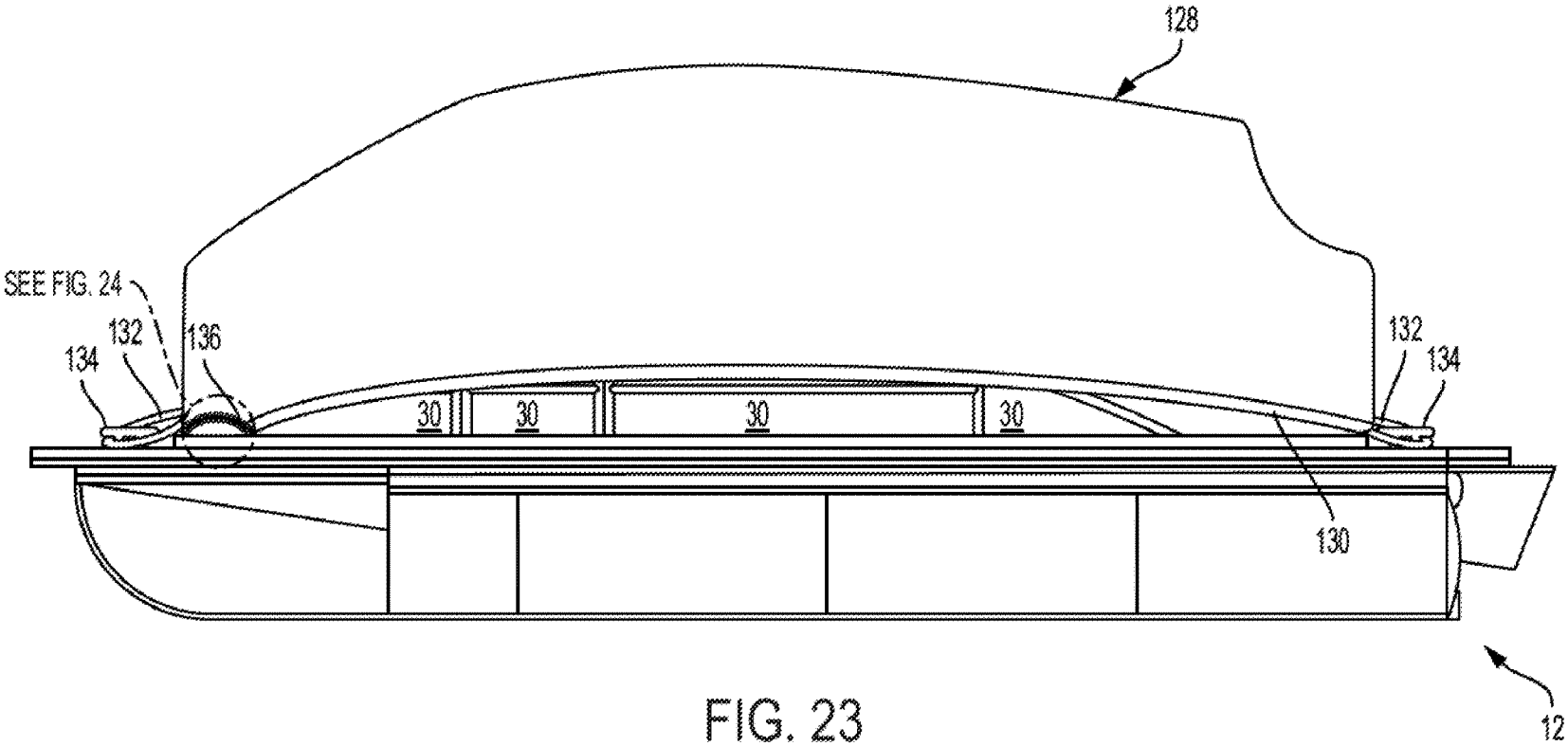
FIG. 23 PRIOR ART
FIG. 23 is an elevation side view of the boat with a prior art sheet over the boat and bimini of FIG. 22.

The MDC Cover System is a canvas for a pontoon boat 12 that uses a bimini top 116 in the ready position as seen in FIG. 22. First, the front portion of the awning 118 is unzipped off of the bimini structure. Then, the front tube 120 is rotated forward and a tent pole 122 is placed between the front tube and the deck 110 of the boat 12 to support the front tube. Then, a smaller tube 124 is rotated forward and a second tent pole 126 is placed between the smaller tube and the deck 110 of the boat 12 to support the smaller tube. The canvas 128 is then placed over the boat 12 and the bimini top 116. The canvas 128 is made from a stretchy material, so it must be stretched over the bimini frame 116 as seen in FIG. 23.

Figure 24:
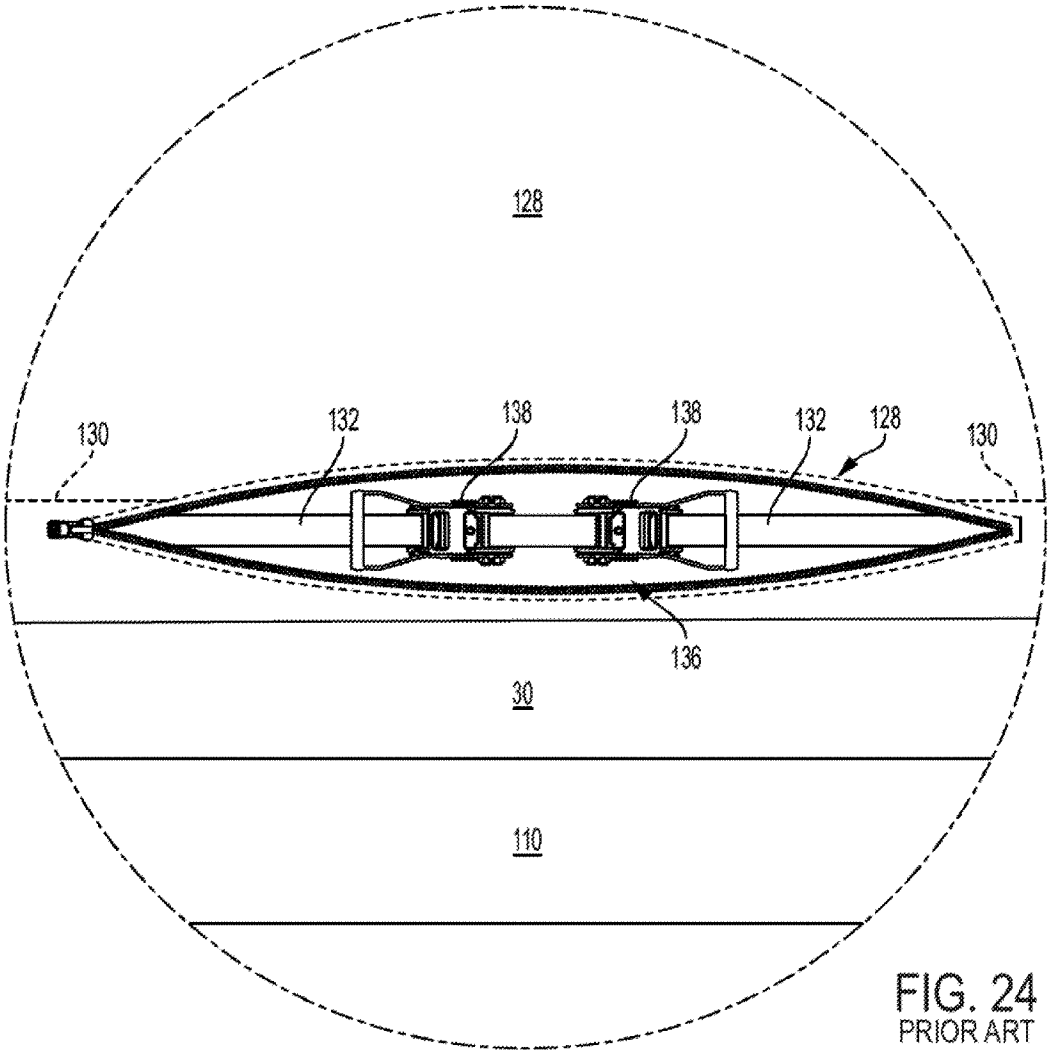
FIG. 24 PRIOR ART
FIG. 24 is an enlarged view of the zippered opening of FIG. 23 as taken along line 24.

Along the bottom of the canvas 128 is a flap 130 through which a band 132 extends. The flap 130 is broken at each corner of the canvas 128 to expose the band 132. At each corner of the canvas 128, the band 132 is wrapped around the cleat 134 to hold the canvas to the boat 12. Also along the bottom of the canvas 128 is a zippered aperture 136. As seen in FIG. 24, once opened, the zippered aperture 136 exposes a pair of ratchets 138. The ratchets 138 can be used to tighten the band 132 around the fence 30 of the boat 12.

The MDC Cover System suffer from a number of disadvantages. First, the MDC Cover System still requires at least two tent poles, 122, 126. Therefore, the MDC Cover System suffers from the same drawbacks discussed above with respect to covers that use tent poles. Second, the MDC Cover System requires substantial disassembly of the bimini structure 116. Therefore, the MDC Cover System requires much more effort to place the bimini structure 116 back into the awning 118 and in working order as a bimini again. Third, the MDC Cover System uses the cleats 134 of the boat 12. Therefore, the cleats 134 are not as accessible for use to tie the boat 12 to a dock. Fourth, the stretchy material of the canvas 128 and fifth, the lack of any supporting elements such as ropes or straps at the top of the canvas 128 makes the MDC Cover System more susceptible to not being properly tensioned, having depressions and water pooling.

Although the invention has been herein described in what is perceived to be the most practical and preferred embodiments, it is to be understood that the invention is not intended to be limited to the specific embodiments set forth above. For example the tensioning means 40 has been described and shown as being attached to the cover material 42. However, the tensioning means 40 could be separate from the cover material 42 without defeating the spirit of the invention. The tensioning means 40 could be loosely attached to the boat 12, the cover material 42 then secured to the boat and the tensioning means 40 tightened thereby giving form and shape to the cover 10. It is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A cover system for a vehicle with an opening and sides, the cover system comprising:

a frame having a first bow, second bow and third bow, the frame movable between a trailering position and a radar position, the third bow pivotally connected to one of the first bow and second bow;

a strut attached to the third bow to selectively hold the frame in the radar position; and a cover for covering the opening of the vehicle, the cover further comprising:

a cover material sized to cover the opening and at least a portion of the sides of the vehicle;

a cord attached to the cover material; and a tightening mechanism connected to the cord;

wherein the third bow can be moved to a support position independent of the radar position when the first bow and second bow are moved to the trailering position and the third bow is selectively held in the support position by the strut;

wherein the cord extends over the third bow when the cover is on the vehicle and the third bow is in the support position; and wherein when the cord extends over the third bow and tension is added to the cord by the tightening mechanism, the strut supports the third bow and the cover, and the cover is formed to shed water.

2. The cover system of claim 1 further comprising:

an ancillary cord attached to the cover material; and a second tightening mechanism connected to the ancillary cord;

wherein when the cover is on the vehicle and tension is added to the ancillary cord by the second tightening mechanism, the cover is at least partially formed to the sides of the vehicle.

3. The cover system of claim 2 further comprising:

a corner strap connected to the vehicle and to the ancillary cord;

wherein the corner strap prevents the ancillary cord from overly compressing a corner of the sides of the vehicle when tension is added to the ancillary cord.

4. The cover system of claim 3, wherein the vehicle is a boat, the sides are sides of a rail and the corner strap is attached to a deck of the boat.

5. The cover system of claim 1 wherein the bow is selectively connected to the frame by a canopy having a compartment and wherein the bow can be moved to the support position independent of the frame when the bow is removed from the compartment.

6. The cover system of claim 1 wherein the tightening mechanism is located under the cover material and wherein the cover material includes an access panel to allow access to the tightening mechanism when the cover is on the vehicle.

7. The cover system of claim 2 wherein when the cover is on the vehicle, the second tightening mechanism is located between the cover material and the vehicle and wherein the cover material includes an access panel to allow access to the second tightening mechanism.

8. The cover system of claim 2 further comprising:

a first restraint for selectively attaching a first portion of the cover to the vehicle;

a second restraint for selectively attaching a second portion of the cover to the vehicle;

wherein the first restraint and second restraint anchor such the cord such that the tightening mechanism can add tension to the cord.

9. The cover system of claim 8 wherein at least one of the first restraint and second restraint has an opening and the ancillary cord extends through the opening of the at least one of the first restraint and second restraint.

10. The cover system of claim 1 wherein the cover further comprises a pocket and wherein the pocket helps form the cover to shed water.

11. The cover system of claim 1 wherein the bow has a second strut to selectively hold the frame in the trailering position.

12. An enclosure system for a boat having an interior and a fence around the interior, the enclosure system comprising:

an enclosure for protecting the interior of the boat, the enclosure further comprising:

a sheet sized to enclose at least a portion of the interior of the boat;

a rope connected to the sheet; and a tightening mechanism connected to the rope for creating a taut enclosure;

a structure for a canopy movable between a first position and a second position, the structure comprising:

a number of structural members;

one of the number of structural members capable of being disengaged from the structure and movable to a third position;

a support member attached to the one of the number of structural members for securing the structure to the boat when the one of the number of structural members is engaged with the structure and the structure is in one of the first position and second position and for securing the one of the number of structural members when the one of the number of structural members is disengaged from the structure and in the third position;

wherein when the one of the number of structural members is in the third position and the enclosure is on the boat and taut, the sheet forms generally inclined surfaces with low points at the fence of the boat and at least one high point at the one of the number of structural members such that water will run off the sheet and the fence of the boat.

13. The enclosure system of claim 12 further comprising:

a second rope connected to the rope; and a first end and second end of the second rope attached to the boat such that the second rope extends through a space between seats on the boat;

wherein the tightening mechanism is attached to the second rope such that as the second rope is tensioned, the rope is tensioned.

14. The enclosure system of claim 13 further comprising:

a third rope connected to the rope; and a first end and second end of the third rope attached to the boat;

wherein the tightening mechanism is attached to the second rope such that as the second rope is tensioned, the third rope is tensioned.

15. The enclosure system of claim 13 further comprising:

a first strap attached to the first end; and a second strap attached to the second end;

wherein the first strap and second strap are attached to the boat such that the second rope is attached to the boat by the first strap and second strap.

16. The enclosure system of claim 15 further comprising:

a first fastener adjustably attached to the first strap for attaching the first strap to the boat; and a second fastener adjustably attached to the second strap for attaching the second strap to the boat;

wherein the first fastener can be adjusted based at least upon a desired length of the first strap; and wherein the second fastener can be adjusted based at least upon a desired length of the second strap.

17. The enclosure system of claim 12 further comprising:

a side rope; and a side tightening mechanism attached to the side rope;

wherein the enclosure further comprises a side portion for enclosing at least a portion of the fence of the boat;

wherein the side rope is attached to the side portion; and wherein the side portion is fit generally to the fence when the side rope is tightened by the side tightening mechanism.

18. The enclosure system of claim 17, further comprising:

a side strap attached to the side rope and to the boat;

wherein the side strap holds the side rope away from a portion of the fence when the side rope is tightened by the side tightening mechanism.

19. The enclosure system of claim 18, wherein when the side strap is attached to the side rope and to the boat, cleats of the boat are unobstructed.

20. The enclosure system of claim 14 wherein at least one of the rope, second rope and third rope are attached to the sheet by extending through sleeves connected to the sheet.

21. The enclosure system of claim 12 wherein the tightening mechanism is a structure selected from a group consisting of a ratchet, a winch, gearing and a pulley.

22. The enclosure system of claim 12:

wherein the structure further comprises a second one of the number of structural members;

wherein the second one of the number of structural members capable of being disengaged from the structure and movable to a position;

a support arm attached to the second one of the number of structural members for securing the second one of the number of structural members in the position;

wherein when the second one of the number of structural members is disengaged from the structure and in the position, the second one of the number of structural members supports the enclosure such that the sheet forms generally inclined surfaces that water will run off the sheet.

23. A cover system for a vehicle with an opening and sides, the cover system comprising:

a frame movable between a first position and a second position;

a bow selectively connected to the frame and having a strut to selectively hold the frame in the second position; and a cover for covering the opening of the vehicle, the cover further comprising:

a cover material sized to cover the opening and at least a portion of the sides of the vehicle;

a cord attached to the cover material; and a tightening mechanism connected to the cord;

wherein the bow can be moved to a support position independent of the frame and the bow is selectively held in the support position by the strut;

wherein the cord extends over the bow when the cover is on the vehicle and the bow is in the support position;

wherein when the cord extends over the bow and tension is added to the cord by the tightening mechanism, the strut supports the bow and the cover, and the cover is formed to shed water; and wherein the bow is selectively connected to the frame by a canopy having a compartment and wherein the bow can be moved to the support position independent of the frame when the bow is removed from the compartment.

24. A cover system for a vehicle with an opening and sides, the cover system comprising:

a frame movable between a first position and a second position;

a bow selectively connected to the frame and having a strut to selectively hold the frame in the second position; and a cover for covering the opening of the vehicle, the cover further comprising:

a cover material sized to cover the opening and at least a portion of the sides of the vehicle;

a cord attached to the cover material; and a tightening mechanism connected to the cord;

wherein the bow can be moved to a support position independent of the frame and the bow is selectively held in the support position by the strut;

wherein the cord extends over the bow when the cover is on the vehicle and the bow is in the support position;

wherein when the cord extends over the bow and tension is added to the cord by the tightening mechanism, the strut supports the bow and the cover, and the cover is formed to shed water; and wherein the tightening mechanism is located under the cover material and wherein the cover material includes an access panel to allow access to the tightening mechanism when the cover is on the vehicle.

* * * * *